US009908322B2

(12) United States Patent
Kress et al.

(10) Patent No.: US 9,908,322 B2
(45) Date of Patent: Mar. 6, 2018

(54) DEVICE AND METHOD FOR ADJUSTING AND/OR MODIFYING A PROFILE IN THE SUPPLY OF DAMPENING MEDIUM, EXTENDING IN THE DIRECTION OF THE PRINTING WIDTH, AND PRINTING UNIT HAVING A DEVICE FOR ADJUSTING AND/OR MODIFYING THE PROFILE

(71) Applicant: KOENIG & BAUER AG

(72) Inventors: Patrick Kress, Bad Mergentheim-Edelfingen (DE); Martin Lanig, Reichenberg GT Fuchsstadt (DE); Volkmar Schwitzky, Würzburg (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/506,355

(22) PCT Filed: Feb. 4, 2015

(86) PCT No.: PCT/EP2015/052259
§ 371 (c)(1),
(2) Date: Feb. 24, 2017

(87) PCT Pub. No.: WO2016/041642
PCT Pub. Date: Mar. 24, 2016

(65) Prior Publication Data

US 2017/0266952 A1 Sep. 21, 2017

(30) Foreign Application Priority Data

Sep. 15, 2014 (DE) ..... 10 2014 218 451
Sep. 15, 2014 (DE) ..... 10 2014 218 452

(51) Int. Cl.
*B41F 33/00* (2006.01)
*B41F 31/00* (2006.01)

(52) U.S. Cl.
CPC ..... *B41F 33/0054* (2013.01); *B41F 31/007* (2013.01)

(58) Field of Classification Search
CPC . B41M 1/06; B41M 1/08; B41F 31/00; B41F 31/002; B41F 31/007; B41F 33/0054
See application file for complete search history.

(56) References Cited

U.S. PATENT DOCUMENTS 4,452,139 A 6/1984 Dahlgren et al.
6,055,905 A * 5/2000 Lemaster ..... B41M 1/06 101/141

(Continued)

FOREIGN PATENT DOCUMENTS

DE 1073001 A 1/1960
DE 2931579 A1 2/1981

(Continued)

OTHER PUBLICATIONS

LechlerDE—Shop/de.
International Search Report of PCT/EP2015/052259 dated Jul. 24, 2015.

*Primary Examiner* — David Banh
(74) *Attorney, Agent, or Firm* — Mattingly & Malur, PC

(57) ABSTRACT

A device one of adjusts and changes a dampening medium profile, which extends in the direction of a printing width, in a printing unit comprising at least one printing unit cylinder, at least one inking unit which inks the printing unit cylinder, and at least one dampening unit which interacts with one of the printing unit cylinder and the printing unit. A drying device, which extends over the printing width, is provided with a number I(I∈ℕ , 0>1) of drying elements, the influence of which, on a printing unit surface to be treated, allows moisture to be removed from a number of n(n∈ℕ , n>1) axial portions $a_j$(j=1, . . . , n) that are offset relative to one another in the direction of the printing width. One of an extent of the influence of the drying device with respect to the axial direction ($a_j$) and the operating state of the drying device can be varied independently of one another. The drying elements are designed and arranged in the printing unit such that at least 20% of the width ($b_j$), when seen in the direction of the (Continued)

printing width, of multiple or all of the axial portions ($a_j$), which are designed as active portions ($a_j$) with an active width ($b_j$) of the drying elements in the printing unit, over the extension of those portions, overlaps with an adjacent axial portion of the axial portions ($a_j$), which are axially offset relative to one another in the direction of the printing unit. A controller and one of a switching and an adjusting device, which are connected to the controller for signaling purposes, are provided. The controller and the one of the switching and adjusting devices are used to operate multiple or all of the drying elements during a stationary active operating state such that each of the drying elements is pulsed, i.e. is individually clocked between an "off" switching state and an "on" switching state.

16 Claims, 10 Drawing Sheets

(56) References Cited

U.S. PATENT DOCUMENTS

| | | | | |
|---|---|---|---|---|
| 6,145,437 | A | 11/2000 | Böck et al. | |
| 6,418,844 | B1 * | 7/2002 | Franklin | B41F 31/007 101/147 |
| 6,568,324 | B1 * | 5/2003 | Franklin | B41F 31/007 101/364 |
| 2007/0199462 | A1 | 8/2007 | Cyman, Jr. et al. | |
| 2013/0032050 | A1 * | 2/2013 | Pattekar | G03G 15/10 101/148 |
| 2013/0321545 | A1 * | 12/2013 | Vandagriff | B41J 11/0085 347/104 |
| 2015/0290927 | A1 * | 10/2015 | Franz | B41F 31/14 101/348 |

FOREIGN PATENT DOCUMENTS

| | | | |
|---|---|---|---|
| DE | 2931579 | C2 | 2/1981 |
| DE | 3220701 | A1 | 12/1983 |
| DE | 3247761 | A1 | 6/1984 |
| DE | 4206525 | A1 | 9/1993 |
| DE | 69307643 | T2 | 7/1997 |
| DE | 29805201 | U1 | 7/1998 |
| DE | 19924997 | A1 | 12/2000 |
| DE | 19958252 | A1 | 6/2001 |
| DE | 10160734 | A1 | 7/2002 |
| DE | 102008042620 | A1 | 4/2010 |
| EP | 1033245 | A1 | 9/2000 |
| EP | 1964678 | A2 | 9/2008 |
| EP | 2008815 | A2 | 12/2008 |
| WO | 2014/056711 | A1 | 4/2014 |

* cited by examiner

DEVICE AND METHOD FOR ADJUSTING AND/OR MODIFYING A PROFILE IN THE SUPPLY OF DAMPENING MEDIUM, EXTENDING IN THE DIRECTION OF THE PRINTING WIDTH, AND PRINTING UNIT HAVING A DEVICE FOR ADJUSTING AND/OR MODIFYING THE PROFILE

CROSS REFERENCE TO RELATED APPLICATIONS

This application is the U.S. National Phase, Under 35 U.S.C. § 371, of PCT/EP2015/052259, filed Feb. 4, 2015; published as WO2016/041642A1 on Mar. 24, 2016 and claiming priority to DE 10 2014 218 452.5, filed Sep. 14, 2015, and to DE 10 2014 218 451.7, also filed Sep. 15, 2014, the disclosures of which are expressly incorporated herein by reference.

FIELD OF THE INVENTION

The present invention relates to a device and to a method for adjusting and/or modifying a profile in the supply of dampening medium, extending in the direction of a printing width, and to a printing unit having a device for adjusting and/or modifying the profile. The printing unit has at least one printing unit cylinder, at least one inking unit for inking up the printing unit cylinder, and at least one dampening unit that cooperates with one of the printing unit cylinder and the inking unit. A drying device, which extends over the printing width, is provided with a number of $I(I \in \mathbb{N}, 0>1)$ drying elements, the influence of which, on a surface (F) of the printing unit to be treated, allows dampening medium to be removed from a number of n ($n \in \mathbb{N}$, n>1) axial sections $a_j(j=1, \ldots, n)$ that are offset relative to one another in the direction of the printing width and the extent of the influence of which with respect to one of the actual section ($a_j$) and the operating state of which can be varied independently of one another. During operation of the device, excess dampening medium is removed from a printing unit, from a plurality of axial sections offset relative to one another in the direction of the printing width, by a drying device that has a plurality of drying elements which are individually adjustable, in terms of their actions. The printing unit is embodied as a collect printing unit having a transfer cylinder that cooperates upstream, with respect to the flow of ink, with a plurality of forme cylinders and downstream with one of a printing unit cylinder that serves as a counter bearing for the transfer cylinder and by the arrangement of the printing unit in a printing unit assembly of a printing press which is embodied as a security printing press.

BACKGROUND OF THE INVENTION

DE 29 31 579 C2 relates to a device and a method for the zonal regulation of a dampening medium profile, extending over the width of a printed page, in a printing unit having a printing unit cylinder, at least one inking unit for inking up the printing unit cylinder and at least one dampening unit that cooperates with the printing unit cylinder and/or the inking unit, wherein a drying unit that extends over the printing width and has a number of blow tubes is provided, by which dampening medium can be removed from a number of axial sections that are offset in relation to one another in the direction of the printing width. The drying action of each of said blow tubes with respect to a surface to be treated can be varied by a positioning adjustment, coupled mechanically or electronically to the ink zone adjustment, wherein said positioning adjustment, which is coupled to the ink zone adjustment in each case, may be achieved for example, by using individual valves to vary the blowing angle or to vary the blowing air. In a common feed line to the blow tubes, a valve may also be provided, which can be used to adjust the dependence of the volume of dampening medium that is blown off on the volume of ink that is supplied, based on the factors of the volume of blowing air that influence the volume of water.

In DE 32 20 701 A1, excess dampening medium is removed by means of doctor blade sections, preferably embodied as suction elements, from a cooled chromium roller that rolls in the manner of a rider roller against an inking unit roller. The doctor blade sections are controlled based on measurement signals from sensors that are directed toward the lateral surface of the chromium roller and register an oversupply of dampening medium.

DE 32 47 761 C2 discloses a measuring roller that rolls in the manner of a rider roller against an inking unit roller, and on which the volume of dampening medium, which is determined zonally by means of sensors on the measuring roller, can be modified zonally by measuring how long each zonally assigned heat source is switched on.

DE 42 06 525 C2 discloses a device for influencing zonal dampening medium distribution, in which zonally adjustable throttle elements in the form of dampers or slide valves are provided, which can be used for progressively closing or opening, by means of a thermally switchable drive means, an air outlet opening that is directed toward an inking unit roller and extends over the entire width thereof. When two such drive means arranged in series are used, the throttle elements covering the opening can be adjusted gradually.

In DE 1 073 001, excess dampening medium is pushed back by means of an air nozzle directed toward the printing forme, with the air jet blowing at an incline in the direction of rotation of the forme cylinder.

In DE 10 2008 042 620 B4, during the color separation process, even small volumes of ink that are returned upstream are freed of any dampening medium by means of a microwave dryer before being returned to the ink supply.

WO 2014/056711 A1 discloses a printing press that operates using a simultaneous two-sided multicolor printing process for security printing and has a printing unit comprising a plurality of inking and dampening units.

A catalog entitled "Air Nozzles", available from the Lechler company on the website "httpl/www.lechler.de/isbin/intershop.static/WFS/LechierDE-Shop-Site/LechlerDE-Shop/de_DE/PDF/05_service support/industrie/katalog/deutsch/Katalog_112/06_Luft_d_0613.pdf" and dated 15 Sep. 2014, discloses on page 6.8 tongue nozzles, which are described as suitable for use in blowing away liquids, for example.

EP 1 033 245 A1 discloses a spray dampening unit having spray nozzles for spraying dampening medium onto a roller. The spray nozzles are pulsed at a frequency and a predefined phase shift.

DE 101 60 734 A1 discloses a printing press in which a temperature control roller extends over the entire width of a roller, and additional temperature control rollers that are offset from the first in the circumferential direction each extend over the width of a printing forme. These additional temperature control rollers can be used for controlling ink density by printing forme.

In DE 199 24 997 A1, dampening medium is evaporated in an inking unit of a printing press by the provision of a vacuum chamber on the peripheral surface of a roller. In addition, a further vacuum chamber may be provided on an opposite longitudinal side of the roller, in other words offset by approximately 180°.

DE 693 07 643 T2 relates to a device for removing dampening solution in printing presses, in which a plurality of fans are provided axially along a roller and directed toward the roller surface. Using appropriate switching means, the width of the group of active fans can be adjusted to the printing substrate width, and the air volume of each can be adjusted to the level of dampness.

DE 199 58 252 A1 discloses a moisture-controlled printing press, in which a blower assembly is directed toward the surface of a roller that is wetted with dampening medium. The flow rate of this blower assembly can be regulated by means of fans arranged side by side in the axial direction, or by means of a plurality of zonally distributed nozzle openings that are supplied with air via a blower.

DE 298 05 201 U1 relates to an anilox inking unit for an offset rotary printing press, having a blowing device for use in removing any surface water that may be present on the surface of the anilox roller. In one embodiment, the blowing device is provided by nozzles embodied as holes in a nozzle bar, the air volume of which can be regulated over the width of a page. In another embodiment, the blowing device is provided by individually controllable fans. In the case involving nozzle openings, valves can be used to control the volume of air passing through each group of openings. The volume of air can also be adjusted by varying the pressure level present on the intake side of the blower assembly. Said device is also intended for use in keyless inking units that do not contain anilox rollers.

U.S. Pat. No. 4,452,139 A relates to a method and a device for inking up and dampening an offset printing plate using one or more of four evaporator devices disclosed therein. In three of the evaporator devices, air is blown onto a roller surface through a slit-shaped or slot-shaped opening, and in a fourth embodiment, air is blown through nozzles arranged adjacent to one another, with the fan-like streams from said nozzles overlapping to produce a continuous stream.

EP 2 008 8915 A2 relates to a method and a device for applying dampening medium or ink in which the application thereof is pulsed.

SUMMARY OF THE INVENTION

The object of the present invention is to provide a device and a method for adjusting and/or modifying a profile in the supply of dampening medium, extending in the direction of a printing width, and a printing unit having a device for adjusting and/or modifying the profile, with which a high print quality can be achieved during printing, over a wide range of ink infeed volumes with respect to the surface area to be printed.

The object is achieved according to the invention by the provision of the drying elements being embodied and arranged in the printing unit in such a way that at least 20% of the width ($b_j$), as seen in the direction of the printing width, of multiple or all of the axial sections ($a_j$), which are embodied as active section $(a)_j$ having an active width ($b_j$) of the drying elements in the printing unit, over the extension of those sections, overlap with an adjacent axial section of the axial sections ($a_j$), which are axially offset relative to one another in the direction of the printing width. A control device and one of a switching and an adjusting device, which are connected to the controller for signalling purposes, are provided. At least one of multiple ones of, and all of the drying elements one of can be and are operated during a stationary active operating state such that each of the drying elements is pulsed, i.e. is individually clocked between an "off" switching state and an "on" switching state. In at least one operating situation, dampening medium is removed from at least one axial section. A length of at least 20% of the active width ($b_j$) of the axial section ($a_j$), which is formed as an active section ($a_j$) of an active drying element, overlaps the active width ($b_j$−1); ($b_j$+1) of an axial section ($a_j$−1; $a_j$+1) that is embodied as the active section ($a_k$−1; $a_j$+1); of an adjacent active drying element of the drying elements which are offset axially relative to one another in the direction of the printing width. An extent of the influence of the axial section ($a_j$) in question on the surface to be treated is adjusted individually to an operating state that lies between an inactive operating state and an operating state with maximum action. The drying element is operated discontinuously in a clocked manner between an "off" switching state and an "on" switching state.

The advantages that can be achieved with the present invention consist, in particular, in that during printing, a high print quality can be achieved over a wide range of ink infeed volumes with respect to the surface area to be printed. This can be achieved even and/or particularly in conjunction with the use of a dampening unit that is not adjustable zonally with respect to the infeed of dampening medium, or is not adjustable zonally to the same extent as an assigned inking unit, i.e. is not adjustable zonally or is adjustable only in wider sections than an assigned inking unit.

The invention enables greater variability in blowing intensity and a finer gradation of the axial profile to be achieved, resulting in an improvement in print quality for both high and very low ink density.

In an embodiment of a device for adjusting and/or modifying a dampening medium profile that extends in the direction of a printing width in a printing unit, which embodiment is particularly suitable in terms of good print quality for even the smallest ink volumes, and which printing unit comprises at least one printing unit cylinder, at least one inking unit for inking up the printing unit cylinder, and at least one dampening unit that cooperates with the printing unit cylinder and/or the inking unit, a drying device is provided, extending over the printing width and having a plurality of drying elements, the action of which on a printing unit surface to be treated allows dampening medium to be removed from a number of axial sections that are offset in relation to one another in the direction of the printing width, with the extent of the influence of each drying element on the axial section being variable independently of the other drying elements.

In a first particularly advantageous embodiment of this device, the drying elements—embodied in an advantageous variant as nozzles—are configured and arranged in the printing unit in such a way that multiple or all of the axial sections, which are embodied as active sections having the active width of the drying elements in the printing unit, overlap an adjacent axial section by at least 20% of their width, as viewed in their extension in the direction of the printing width. In an advantageous refinement, each of the drying elements assigned to the axial sections for removal of the dampening medium can be adjusted individually, in particular by remote actuation, in terms of the extent of its influence on the surface to be treated, by means of control elements that are part of an operator interface which can be manipulated by press operators.

In another particularly advantageous embodiment of the aforementioned particularly suitable device—in place of or in addition to the features of the former particularly advantageous embodiment of the device—multiple or all of the drying elements assigned to the axial sections for removal of the dampening medium can each be varied individually in terms of the extent of its influence, averaged over time or over surface area, on the surface to be treated, using control elements that can be manipulated by press operators and a control device that is connected for signaling purposes to the control elements, between an inactive operating state, an active operating state that represents a maximum value, and at least one active operating state that assumes an intermediate value that lies therebetween, and/or a control device is provided, with which multiple or all of the drying elements can be or are operated during an active operating state such that each of the drying elements is individually clocked, or pulsed, between an "off" switching state and an "on" switching state.

During operation, excess dampening medium is removed from a printing unit, from a plurality of axial sections that are arranged offset in relation to one another in the direction of the printing width, by means of a drying device comprising a plurality of drying elements, the action of each of which can be adjusted independently. In a particularly advantageous embodiment, in a sequence or operating situation in which e.g. dampening medium can be removed particularly quickly and/or thoroughly, dampening medium is removed from at least one of the axial sections in that the axial section, which is embodied as an active section of an active drying element, overlaps the active width of an axial section that is embodied as the active section of an adjacent active drying element by a length of at least 20%, and advantageously even 40-60% of its active width. This allows the capacity for gradation to be improved. In another particularly advantageous embodiment—in place of or in addition to the first described particularly advantageous embodiment of the device operation—the degree of action on a circumferential section in a relevant axial section is varied individually between an inactive operating state, an active operating state that represents a maximum value, and at least one active operating state that assumes an intermediate value lying therebetween, based on parameters that are input by manipulating control elements that are connected for signaling purposes to a control device.

Features mentioned above, that represent refinements of particularly advantageous devices and methods and are described in the following and in reference to embodiment examples and/or in the features of the claims, may be applied individually or in multiples to form an advantageous refinement.

In a particularly cost-effective and/or robust solution, the switching and/or adjusting means may be embodied as binary switching means, in particular as a valve that can be switched between an "on" state and an "off" state—e.g. without intermediate operational values. Alternatively—in particular for an embodiment in which the amount of jet power is variable—a continuously adjustable valve may be provided.

Through a specific adjustment of the drying elements, a pattern of drying medium application that has areas of single, double and no application can be achieved.

In one advantageous embodiment, clocking may be implemented to achieve a varied action per unity of area.

In a preferred embodiment, the drying elements may be configured as blowing elements, in particular as nozzles, preferably as flat-jet nozzles and/or as nozzles in what is known as a deflector or baffle plate construction.

Positioning a switching element upstream that can then be used to adjust the level for multiple or all of the drying elements simultaneously allows the action of the blowing elements as a whole to be adapted to specific operating conditions.

An "overlap" as used herein is not understood as either a complete covering of one of the two axial sections involved or the congruence of the axial sections with respect to axial position and length. In particular, an "overlap"—with respect to an equal or smaller of the two axial sections in question—amounts to no more than 80%, preferably no more than 60% coverage.

BRIEF DESCRIPTION OF THE DRAWINGS

Embodiment examples of the invention are illustrated in the set of drawings and will be specified in greater detail in the following.

The drawings show.

DESCRIPTION OF THE PREFERRED EMBODIMENT

Figure 1:
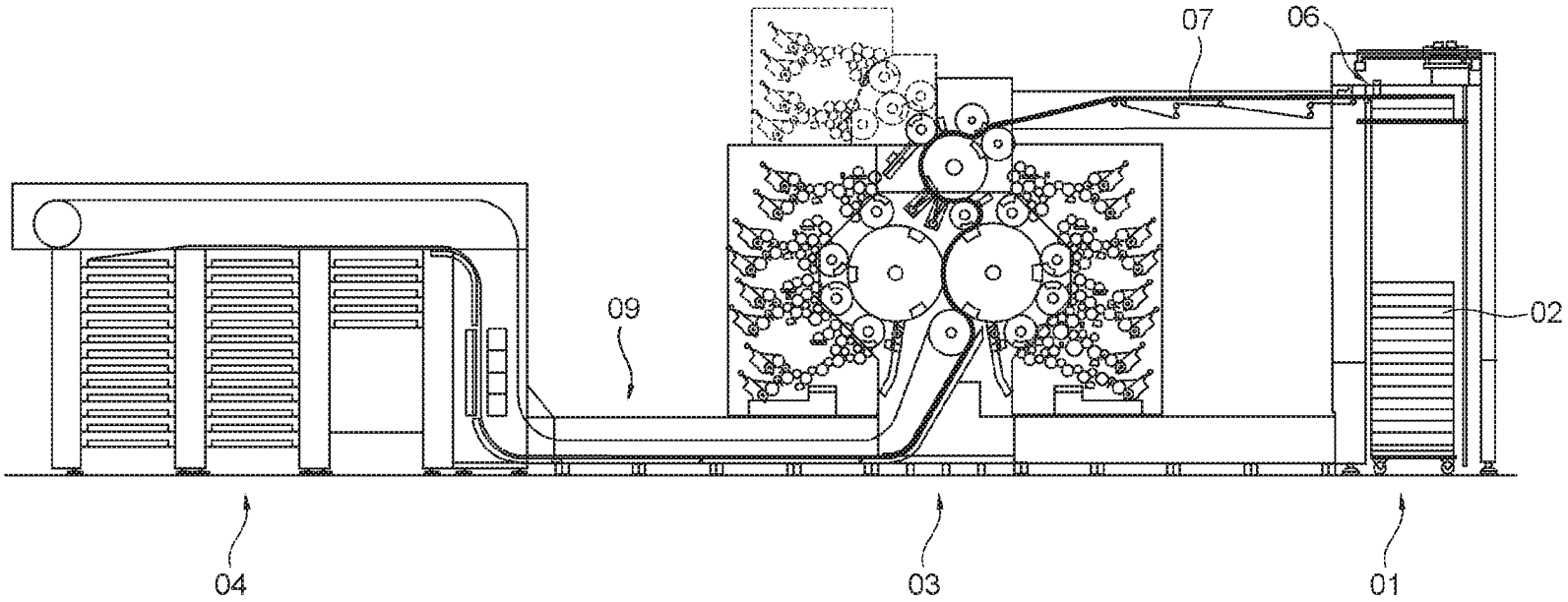
FIG. 1 an exemplary embodiment of a printing press comprising one printing unit assembly.

A printing press, e.g. a sheet-fed printing press or a web-fed printing press, comprises on the intake side an infeed device 01, which supplies the printing press with a sheet-type or web-type printing substrate 02, at least one printing unit assembly 03, with which the printing substrate 02 is imprinted in single or multiple colors on one or both sides, and a product delivery unit 04, where imprinted products or intermediate products are delivered in stacks or continuously (see, e.g. FIG. 1). In a preferred embodiment illustrated in the figures, the printing press is embodied as a printing press for security printing, for example, for printing web-type printing substrate 02, e.g. a printing substrate web, or preferably for printing sheet-type printing substrate 02, e.g. printing substrate sheets 02. Infeed device 01 is configured in this case e.g. as a sheet feeder 01, which is configured to hold a stack of printing substrate sheets 02 to be fed in and printed. Printing unit assembly 03 of the printing press embodied e.g. as a security printing press may, in principle, be embodied as a printing unit assembly 03 that operates based on any printing process, preferably on a direct or more particularly a direct lithographic printing process. In the example shown, the printing unit is embodied for imprinting the printing substrate 02 at least on one side in an indirect letterpress process and/or in an offset process. Printing substrate 02 is most preferably embodied as paper that is made e.g. from textile, linen or hemp fibers, and/or that preferably comprises watermarks before being printed.

The printing press is preferably embodied as a sheet-fed printing press for security printing, and is embodied e.g. for producing printed sheets, in particular security sheets, e.g. sheets containing banknotes, as products or as intermediate products to be further processed, from sheets of printing substrate 02.

In that case, the printing substrate sheets 02 are held in reserve in the infeed device 01 embodied as a sheet feeder 01, from which they are picked up individually by a gripping device 06 that comprises suction cups for example, not shown in detail, after which said sheets are conveyed separately along a conveyor path 07, e.g. a conveyor system 07, preferably embodied as a belt system 07, up to an intake region into the printing unit assembly 03. At the intake to printing unit assembly 03, printing substrate sheet 02 is transferred to a conveyor path 08 assigned to printing unit assembly 03, e.g. a conveyor system 08 assigned to printing unit assembly 03, along which printing substrate sheet 02 passes one or more print positions 11; 12 along its transport path, before being transferred from this conveyor path 08 assigned to printing unit assembly 03 to a third conveyor path 09, e.g. a belt system 09, which then transports said sheet up to product delivery unit 04, e.g. a product delivery unit 04 that comprises one or more sheet delivery points where stacks are formed.

Conveyor path 08 assigned to printing unit assembly 03 (see, e.g. FIG. 2) is preferably embodied as a gripper system 08, in which printing substrate sheet 02 is conveyed by successive transfers among a plurality of drums and/or cylinders arranged sequentially in the direction of transport along the transport path through printing unit assembly 03. At the end of conveyor path 08 embodied e.g. as a gripper system 08, printing substrate sheet 02 is transferred to the third conveyor path 09.

In the preferred embodiment of printing unit assembly 03, said assembly comprises a printing unit 11 embodied e.g. as an offset printing unit 11, preferably configured as a collect printing unit 11, on at least one side of conveyor path 08. Printing unit 11 comprises at least one first ink conveying printing unit cylinder 12, embodied as transfer cylinder 12, which cooperates upstream with respect to the flow of ink with at least one additional printing unit cylinder 13, e.g. at least one first forme cylinder 13, and in the embodiment as a collect printing unit 11 preferably with a plurality of forme cylinders 13, and on the other side, over the printing substrate 02 to be imprinted, cooperates with a printing unit cylinder that serves as a counter bearing for the first transfer cylinder 12, e.g. an impression cylinder 14. At their nip point, transfer cylinder and impression cylinder 12; 14 form a print position 16, where printing ink is delivered by transfer cylinder 12 to printing substrate 02. The at least one forme cylinder, more particularly each of forme cylinders 13, can be inked up by an inking unit 17 arranged upstream in printing unit 11—with respect to the resulting flow of ink—and can be wetted with dampening medium by means of a dampening unit 18. In principle, inking unit and dampening unit 17; 18 may each be in direct contact, separately from one another, one or more times with the lateral surface of the forme cylinder, or instead of this separate contact with forme cylinder 13, for example, or preferably in addition to this direct contact of each with forme cylinder 13, they may be in contact with one another via roller contact, one or more times upstream of forme cylinder 13, as described below, so as to enable an exchange of fluid, e.g. rolling contact. Particularly if inking unit and dampening unit 17; 18, in addition to or in place of coupling via forme cylinder 13, are coupled with one another fluidically upstream of forme cylinder ˆ13, they may also be referred to jointly as inking and dampening unit 17, 18.

In a preferred embodiment, first printing unit 11 is a component of a blanket-to-blanket printing unit 11, 21 for simultaneous double-sided printing, in which impression cylinder 14 is embodied as a second ink conveying printing unit cylinder 14, for example, as a second transfer cylinder 14, of a second printing unit 21, based in principle on any printing process, but likewise embodied, for example, as an offset printing unit 21. The printing unit cylinder 14 embodied as transfer cylinder 14 in turn cooperates with at least one forme cylinder 19. In the interest of simplicity, the second inking units and dampening units 17; 18 for respectively inking up and wetting the second forme cylinder 19 are identified using the same reference signs as have been used for the first inking units and dampening units 17; 18, since for the case described here, they have the same configuration, with the exception of their positioning and orientation in printing unit assembly 03.

In principle, for the preferred embodiment of a multicolor single-sided, or more particularly double-sided printing process, a plurality of printing units 11; 21, each comprising an inking unit 17, a dampening unit 18 and forme and transfer cylinders 12; 13; 14; 19, or in the case of simultaneous double-sided printing, corresponding blanket-to-blanket printing units 11, 21, may be provided one in front of the other in the printing substrate path. Preferably, however, a plurality of first forme cylinders 13, e.g. four, cooperate in succession with the peripheral surface of the same first transfer cylinder 12 on one side of the printing substrate, and together form a printing group of a single-sided collect printing unit 11 for simultaneous multicolor printing. A plurality of second forme cylinders 19, e.g. four, having allocated inking units and dampening units 17; 18, preferably also cooperate on the other side of the printing substrate with a second transfer cylinder 14 as a single-sided collect printing unit 09, and together with the first printing group form a collect printing unit 11, 21 for simultaneous double-sided multicolor printing. Between the transfer cylinders 12; 14, print position 07 is formed as a blanket-to-blanket print position 07. Collect printing units 01 of this type for printing on both sides simultaneously are advantageous particularly in cases in which maintaining register—on the same side of the printing substrate and on both sides relative to one another—and/or maintaining a specific coloration are critical. A printing unit assembly 03 or blanket-to-blanket printing unit 11, 21 of this configuration is preferably embodied for double-sided multicolor printing for security printing. Printing substrate 06 may be embodied as web-type substrate or more preferably in the form of individual sheets.

In principle, inking unit 17 may be configured in any way with a single-train roller train that comprises a plurality of rollers 23; 24; 26; 27 and extends downstream from an ink infeed device 22 to forme cylinder 13; 19, or is optionally divided at least partially into a plurality of parallel strands of rollers. At the downstream end, the roller train or inking unit 17 cooperates during operation via one or more rollers 27, also designated as forme rollers 27, more particularly ink forme rollers 27, or via inking unit roller 27 of the roller train, with the lateral surface of the appropriate forme cylinder 13; 19. Inking unit 17 is preferably embodied as a zonally adjustable inking unit 17 with respect to the volume of ink to be introduced, in which a number m ($m \in \mathbb{N}$, $m>1$, advantageously $m \geq 20$, e.g. $m=28$) of ink zones $z_i$ ($i=1, \ldots, m$) that are adjustable by means of switching and/or control means, not shown, are provided side by side over at least the printing width to be printed by means of printing unit 11; 21. The zones may be formed by individually adjustable metering means, for example pumps and/or valves as switching and/or control means, or preferably by ink blades that can be adjusted individually by means of switching and/or adjusting means embodied as actuating drives. Adjustment may be carried out, in particular by remote actuation, via control elements 59 of an operator interface, for example at a control center 51, in particular a control console 51. A group 53 of such control elements 59 that are and/or can be assigned in terms of circuitry with respect to positioning to the ink zones $z_i$, as pairs of keys or buttons, for example on a delivery table 52 that is used for inspecting printed products, and/or as manipulable fields on a selection display or screen 54 of a display screen 56 that is furnished for the numerical and/or graphic visualization of the respective ink zone adjustment. Manipulation may be carried out by means of control elements of a control unit 57 that interacts with the fields of the selection screen, e.g. a control panel 57 that comprises keys, and in the case of a touchscreen-capable embodiment of display screen 56, optionally by interacting directly with areas of a display screen provided for this purpose, or in combined form by manipulating the field on screen 56 that represents the inking unit zone $z_i$ in question and manipulating the adjustment on control unit 57.

Adjustment by remote actuation in this case—as compared with adjustment on site—means that the control elements 59 can be actuated centrally in the area of the same operator interface, and not merely individually using mechanical or electrical control elements that are provided in decentralized locations for each of the switching and/or adjustment means along the row of inking unit zones $z_i$.

In an advantageous embodiment, the inking unit 17 that cooperates in the first and/or in the second printing unit 11; 21 with the respective forme cylinder 13; 19 is embodied as a vibrator inking unit 17 that introduces ink discontinuously, which is particularly advantageous for printing units 01 in which reliable metering and printing must be ensured even with the smallest volumes of ink. This is of particular importance, for example, for security printing, in particular for security offset printing.

Figure 2:
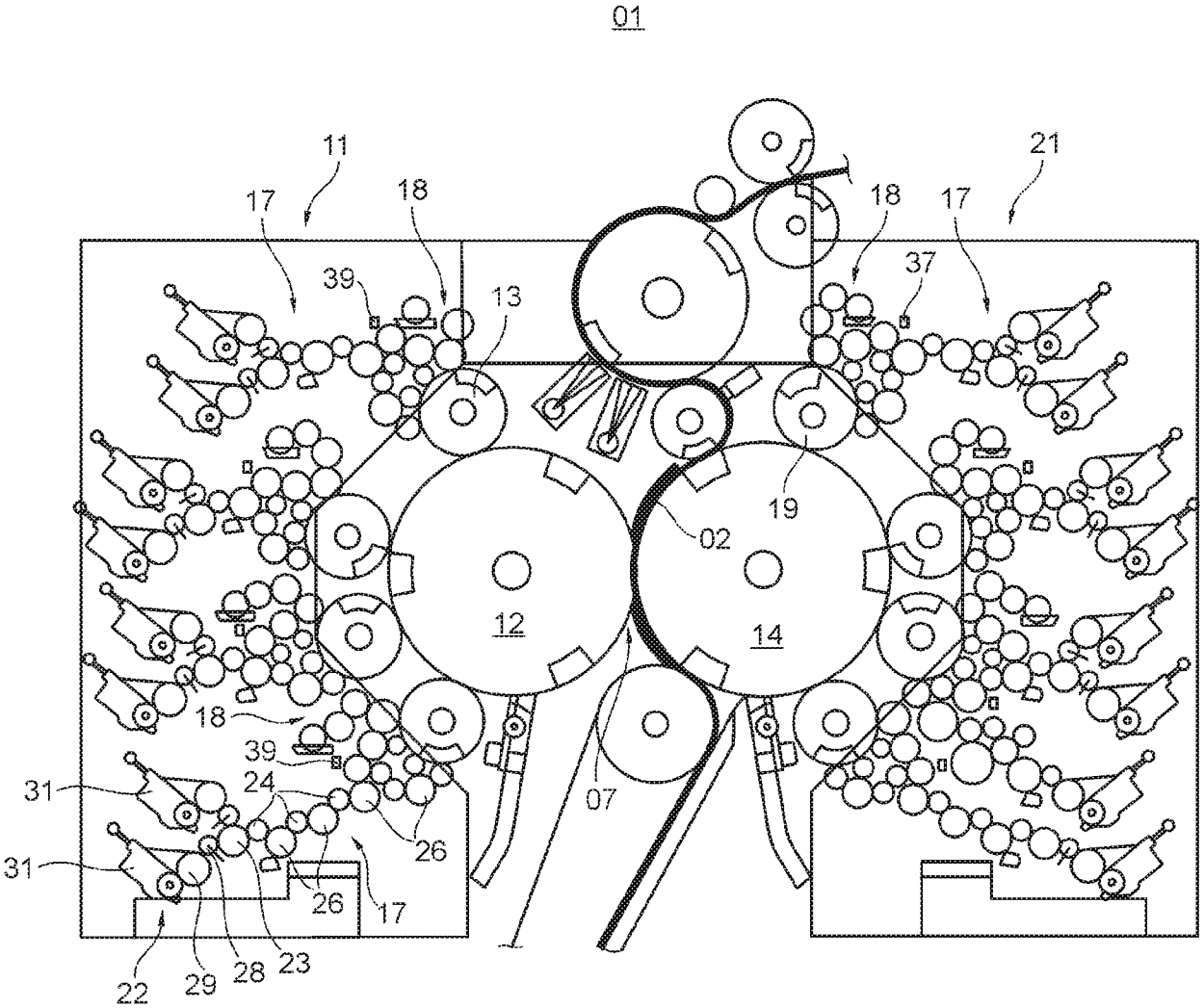
FIG. 2 an enlarged detail view of the exemplary embodiment of a printing unit assembly of FIG. 1.

The inking unit 17 preferably embodied as a vibrator inking unit 17 comprises, at its upstream end, the at least one ink infeed device 22, which comprises a roller, optionally a temperature-controllable roller 29, to be assigned to ink infeed device 22, e.g. a ductor roller 29 or ink fountain roller 29 that forms a metering gap with each of the aforementioned ink blades, an ink source 31, e.g. an ink fountain 31 or a chamber doctor blade device 31, that inks up said roller 29 with printing ink, and a roller 28, e.g. vibrator roller 28, that vibrates between said roller 28 and a first roller 23 of the roller train downstream of and adjacent to the ink infeed device 22 (shown by way of example in inking unit 17 on the bottom right side of FIG. 2). Between the first roller 23 and the at least one forme roller 27, a plurality of additional rollers 24; 26, preferably at least two, may be provided in the roller train leading to forme cylinder 13; 19, for example, at least one inking unit roller 24; 26 embodied with a "soft" surface and one with a "hard" surface (see below). The inking units 17 may comprise different numbers of such rollers 24; 26 disposed between the first roller 23 and the forme roller or rollers 27, depending on the spatial conditions.

The roller 29 embodied as a ductor roller or ink fountain roller 29 is preferably positively rotationally driven, preferably in a clocked manner, e.g. by means of a stepper motor, in steps with angular increments ranging from e.g. 1° to e.g. 65°. Vibrator roller 18 is mounted so as to pivot about a pivot axis extending parallel to the rotational axis of roller 29 of ink infeed device 22. The first roller 23 in the roller train, or the roller situated farthest from the forme cylinder, also called the ink distribution roller 23, has a hard surface, e.g. with a hardness of at least 60 Shore A. It may be embodied, for example, as having a chromed surface, or advantageously as having a surface made of a plastic, preferably such as Rilsan®. Adjacent to and downstream of the first distribution roller or ink distribution roller 23 are additional rollers 24; 26 of the single-train roller train, or the roller train that is preferably divided at least partially into a plurality of parallel partial strands, up to the forme roller or rollers 27 that cooperate with the forme cylinder 12; 19, the roller train preferably comprising as one of the rollers 24; 26 at least one inking unit roller 26 embodied as an oscillating roller, e.g. a so-called distribution roller 26 or distribution cylinder 26. Between ink distribution roller 23 and a first distribution roller 26 downstream, an inking unit roller 24 having a soft surface (e.g. no more than 50 Shore A, preferably no more than 45 Shore A), e.g. ink transfer roller 24, may be provided as roller 24. In a preferred refinement of inking unit 17, said inking unit is embodied as having two ink infeed devices 22 for the parallel infeed of ink into inking unit 17, in which case ink is fed in from each ink infeed device 22, e.g. as described above, in each case from ink infeed device 22 via a roller 29 assigned to the respective ink infeed device 22 to a point downstream on a common first inking unit roller 23, in particular on the same ink distribution roller 23. This parallel infeed of ink enables two-color printing using the same inking unit, in which two inks can be printed side by side or merging into one another ("iridescent printing"). The (each) vibrator roller 28 in the axial direction can have a lateral surface profile in the longitudinal direction in which raised, strip-shaped sections extending circumferentially are interrupted by at least one section which is recessed in relation to the lateral surface line of the raised sections and extends circumferentially in a strip shape.

In principle, dampening unit 18 may likewise be of any embodiment—for example as a contactless or as a contact dampening unit—having a single-train roller train, or a roller train that is optionally divided at least partially into a plurality of parallel roller lines, comprising a plurality of rollers 33; 34; 36, e.g. dampening unit rollers 33; 34; 36, and extending from a dampening medium infeed device 32 downstream to forme cylinder 13; 19. At its downstream end, the roller train or the dampening unit 18 cooperates during operation via at least one roller 34 of the roller train, also designated as forme roller 36, in particular dampening forme roller 36, with the lateral surface of the forme cylinder 13; 19 in question.

In an advantageous embodiment, dampening unit 18 that cooperates in the first and/or the second printing unit 11; 21 with the respective forme cylinder 13; 19 is embodied, e.g. as a—three-roller or four-roller—film dampening unit 18.

Dampening unit 18, embodied e.g. as film dampening unit 18, comprises at its upstream end the at least one dampening medium infeed device 32 with a preferably rotationally positively driven roller 37, e.g. dampening pan roller 37, and a dampening medium source 38 for wetting said roller 37 with a dampening medium film, e.g. a dampening medium trough 38 or a spraying or spinning device. Roller 37 assigned to dampening medium infeed device 32 and embodied, for example, with a hard surface as described above cooperates downstream with a first roller 33 of the dampening unit roller train, e.g. a dampening transfer roller 33, which is preferably embodied with a soft surface. From there, the dampening medium is delivered to a second roller 34 downstream, preferably a dampening unit roller 34 embodied as oscillating, e.g. a distribution roller 34 or distribution cylinders 34, which is in rolling contact with the at least one forme roller 36.

In an advantageous embodiment described herein of the inking and/or dampening unit 17, 18, the dampening unit roller train and the inking unit roller train are also in contact with one another so as to enable an exchange of fluid upstream of the point at which each roller train comes in contact with the forme cylinder 13; 19. This contact exists, for example, between a distribution cylinder 26 which is assigned to the inking unit roller train with respect to a flow of ink directly downstream to forme cylinder 13; 19, and which, in the optional case of a plurality of distribution cylinders 26 provided in series in the roller train, is the distribution cylinder closest to the forme cylinder 13; 19 in this strand, and, for example, the forme roller 36, or one of a plurality of forme rollers, assigned to the dampening medium roller train with respect to the flow of dampening medium directly downstream.

When major zonal differences exist in terms of ink demand, which can occur particularly in security printing due to the extremely small ink volumes that are at times required, deterioration in terms of printed image quality may be caused by the fact that, when ink consumption differs radically between zones, in at least some of the axial sections of the inking and/or dampening unit 17, 18; 17; 18 that advance the m ink zones $z_i$ downstream in the radial alignment, the ink/dampening medium balance may be disrupted by a zonally invariable or zonally less effectively variable infeed of dampening medium. To counter this problem, and to obtain high print quality even under conditions that are particularly difficult in terms of ink distribution, a device, described below, for adjusting and/or modifying a profile in the supply of dampening medium, extending in the direction of the printing width, is provided, by means of which, at least at one point in the flow of fluid in the printing unit 11; 21, dampening medium is removed selectively and individually, in the manner of dampening medium sinks, from n ($n \in \mathbb{N}$, $n>1$, advantageously $n \geq m/2$, in particular $n \geq m \geq 20$, e.g. $m=n+2$, for example, $m=30$) axial sections $a_j$ ($j=1, \ldots, n$) of the inking and/or dampening unit 17, 18; 17; 18, which sections are offset from one another in the direction of the printing width. 'Printing width' is understood in this context as the maximum possible width, extending in the axial direction of the printing unit cylinders 12; 13; 14; 19, to be imprinted by the printing unit 11; 21 in question.

Figure 9:
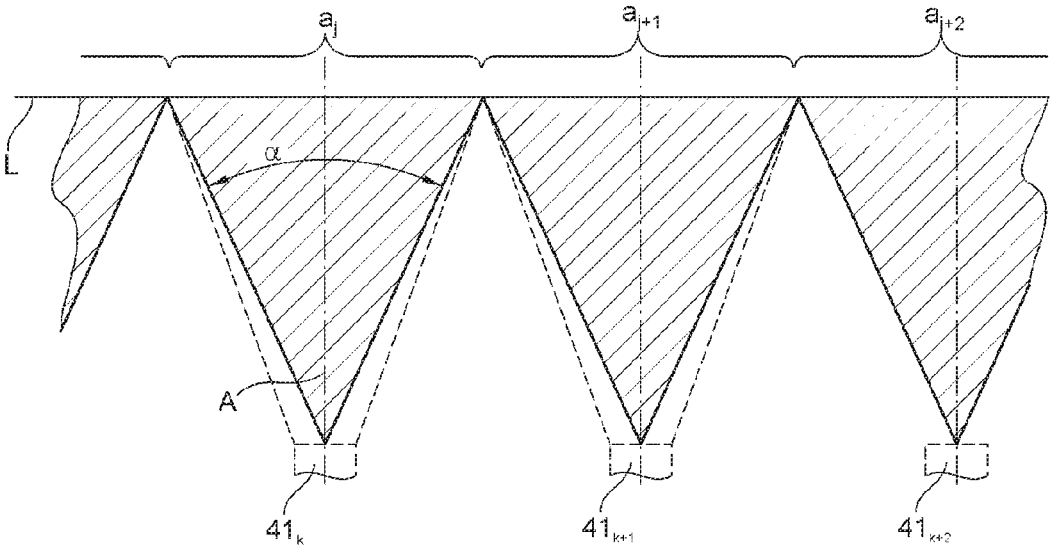
FIG. 9 a schematic diagram illustrating an example of the configuration and arrangement of independently adjustable axial sections which is not a part of the invention.
Figure 10:
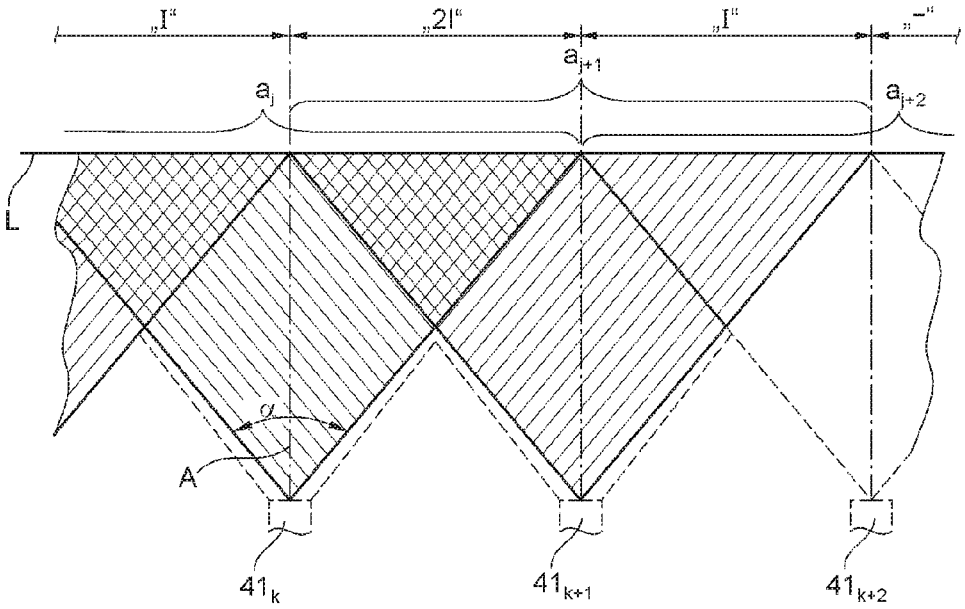
FIG. 10 a schematic diagram illustrating an embodiment, according to the invention, of the configuration and arrangement of independently adjustable axial sections.

In principle, the axial sections $a_j$ to be treated by the device, which are offset relative to one another, may be spaced from one another (not explicitly described) or arranged immediately adjacent to one another (see, e.g. FIG. 9) or may overlap with an adjacent axial section $a_{j-1}$; $a_{j+1}$, e.g. over at least 20%, preferably over at least 30%, more preferably over 40 to 60% of its width—in particular on at least one of its two sides—with an adjacent axial section $a_{j-1}$; $a_{j+1}$ (see e.g. FIG. 10).

The device for adjusting and/or modifying the axially extending dampening medium profile, hereinafter also referred to briefly as the dampening profile adjustment device, comprises for this purpose a drying device 39, directed toward a surface F, in particular lateral surface F of a rotational body 12; 13; 14; 19; 23; 24; 26; 27; 33; 34; 36 embodied as a cylinder or roller, said drying device being preferably embodied as a blowing device 39, having a number I ($I \in \mathbb{N}$, $I>1$), in particular a number I corresponding to the number n of axial sections $a_j$ to be acted on, of drying elements $\mathbf{41}_k$ ($k=0, 1, \ldots, I-1$) that can be adjusted independently of one another with respect to activation and/or intensity and that are directed e.g. toward a surface F of a rotational body 12; 13; 14; 19; 23; 24; 26; 27; 33; 34; 36 embodied as a printing unit cylinder 12; 13; 14; 19 or an inking and/or dampening unit roller 23; 24; 26; 27; 33; 34; 36, and that cooperate in a contactless manner (e.g. via electromagnetic or thermal radiation or via fluid jet) or in contact (e.g. doctor blades or wiping devices) with the lateral surface F, in particular a number I, corresponding to the number n of axial sections $a_j$ to be acted on (i.e. $I=n$), of jet sources $\mathbf{41}_k$, preferably blowing elements $\mathbf{41}_k$, which are adjustable independently of one another with respect to an optional activation and/or a variation in the intensity and/or width and/or temperature of an airflow, and which are directed e.g. toward a surface F of a rotational body 12; 13; 14; 19; 23; 24; 26; 27; 33; 34; 36 embodied as a printing unit cylinder 12; 13; 14; 19 or an inking and/or dampening unit roller 23; 24; 26; 27; 33; 34; 36. A single drying element $\mathbf{41}_k$ or blowing element $\mathbf{41}_k$ is also understood to include a dryer element $\mathbf{41}_k$ or blowing element $\mathbf{41}_k$ that comprises a plurality of functional units that can be adjusted or switched on and off only together, for example a multi-jet blowing element $\mathbf{41}_k$.

The aforementioned independently adjustable axial sections $a_j$ form "dampening zones" that can be adjusted independently by the removal of dampening medium in the manner applied to inking unit 17.

Drying elements $\mathbf{41}_k$ or blowing elements $\mathbf{41}_k$ are arranged in printing unit 11; 21 in such a way that, as viewed in the axial direction, i.e. in the direction of the printing width, the aforementioned axial sections $a_j$ that can be influenced individually are formed by active sections $a_i$, each having a width e.g. an active width $b_i$, said active sections being discernible and/or formed on the rotational body that cooperates with the drying device 39, in the axial direction thereof, based on the effect induced by the application from the respective drying or blowing elements $\mathbf{41}_k$, for example by the impingement thereof with directed electromagnetic radiation from drying elements $\mathbf{41}_k$ embodied as radiation sources or preferably by an impingement with gas from a directed gas jet, which is also understood to include a gas mixture, such as air in particular.

Figure 8:
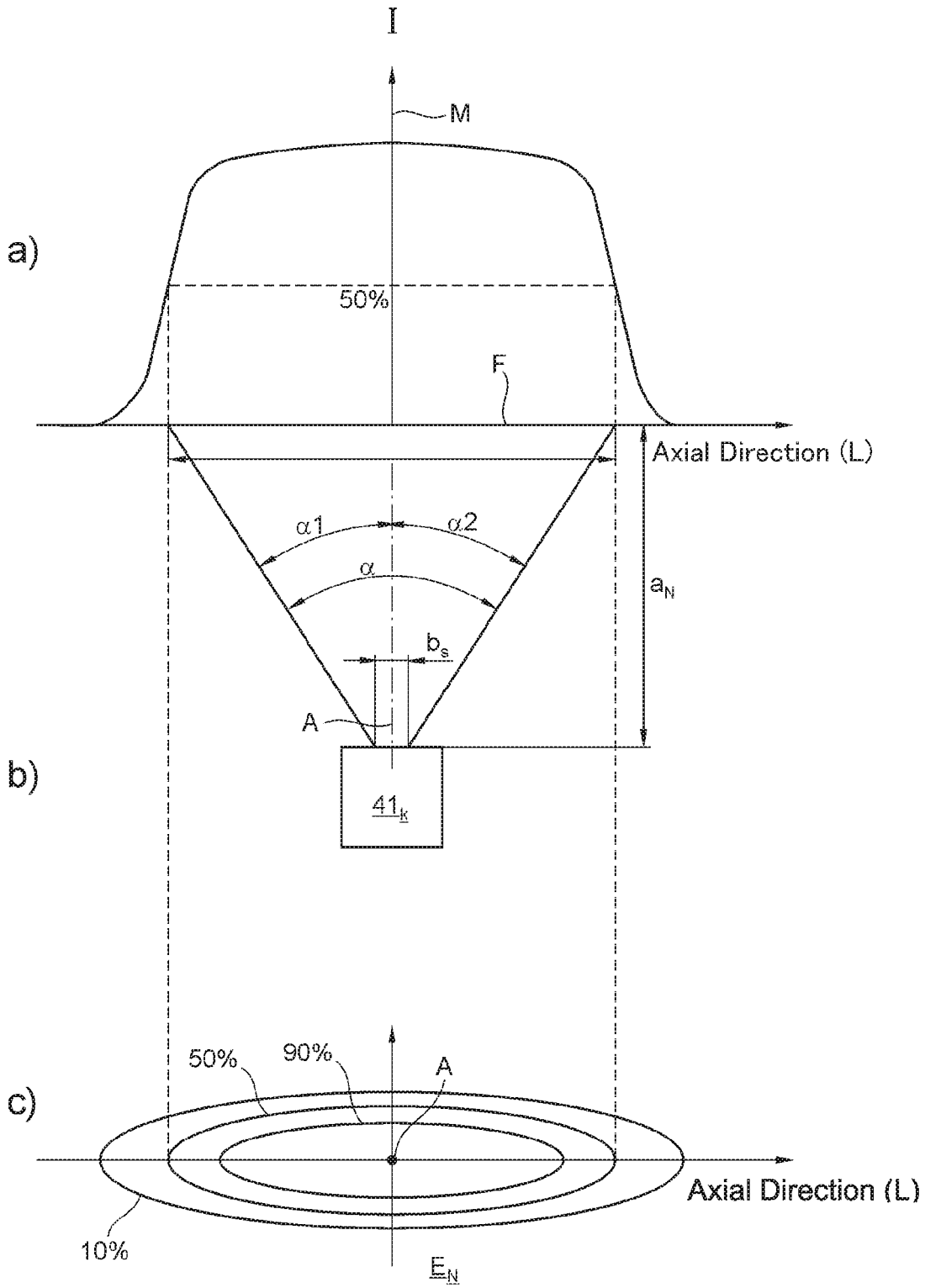
FIG. 8 a schematic diagram of a fluid jet having a jet profile (a) that deviates from a rectangular profile, a jet angle (b) that opens divergently, and a jet pattern that produces a target plane (c)

In general—in the case of an edge or border that is configured as sharp-edged or as not sharp-edged—the section end of axial section $a_j$ may be regarded, for example, as the point in the axial direction of the section in question at which the maximum value, present in a plane that is perpendicular to the mean jet (beam) direction and transverse to the axial direction, for a variable that represents the relevant jet (beam) intensity I per unit area of the plane that is perpendicular to the mean jet (beam) direction, has dropped to 50% of the corresponding maximum value present at the center of the active sections a; thus determined (see, e.g. FIG. 8*a*). In the case of electromagnetic radiation, this variable may be the radiant output per unit area, and for a directed gas jet it may be the volumetric flow per unit area, based on a measurement and/or indication in a plane that is perpendicular to the mean jet (beam) direction of the drying element $\mathbf{41}_k$ in question and encompasses the point of incidence of the mean jet (beam) direction on the surface F (also referred to here as the normal plane $E_N$). In the case of a sharp-edged border, e.g. a border having a step-like edge, the aforementioned value of 50%, among other values, also lies on this lateral edge.

The mean jet (beam) direction, or jet (beam) axis A, is understood as the jet (beam) direction, as viewed in the aforementioned normal plane $E_N$, which results from an averaging over the entire jet (beam) S with respect to the flow of energy or gas. This jet (beam) direction coincides, for example—particularly if the jet (beam) is symmetrical about the central jet (beam)—with the central jet (beam) of jet (beam) S—embodied, for example, as a round jet (beam), an elliptical jet (beam) or an approximately slot-shaped or rectangular flat jet (beam) (see, e.g., FIG. 8).

For cases in which the lateral drop in intensity, as viewed in the axial direction, from 90% of the maximum jet (beam) intensity I to 10% occurs over only 10% of the width in the axial direction to be established in the above manner over the 50% boundary, in the following description, the active width $b_i$ will be assumed to be a substantially or nearly sharp-edged axial section $a_j$ having a width in the axial direction to be established in the above manner over the 50% boundary (see, e.g. 10%, 50% and 90% isolines in FIG. 8*c*). In each case mentioned—whether sharp-edged, nearly sharp-edged, or sloping more gently—the active width $b_i$ can be seen in the axial extension of axial section $a_j$ that lies the distance between the two terminal 50% values for the aforementioned jet intensity I.

Unless drying element $\mathbf{41}_k$, formed by a jet (beam) source $\mathbf{41}_k$, can be regarded as a point source which has an axial extension that is negligible in relation to the active width $b_i$, e.g. at least 100 times smaller, the axially extending width $b_B$ of jet (beam) S at the level of the jet (beam) outlet, i.e. at the location where jet (beam) S exits the drying element $\mathbf{41}_k$ and enters between drying element $\mathbf{41}_k$ and the surface F to be treated, corresponds at most to the active width $b_i$ achieved and/or to be achieved on surface F. In a preferred embodiment, however, a divergent jet (beam) is provided, in which the width $b_B$ of jet (beam) S at the location of the jet (beam) outlet, e.g. also referred to as the base width $b_B$, corresponds to at most 50%, in particular at most 20% of the active width $b_i$ of the axial section $a_j$ provided for treatment, to be achieved on the surface F to be dried—at least under operating conditions, e.g. an operating pressure of, for example, between 1 and 6 bar, in particular between 2 and 5 bar, preferably 3.0±0.5 bar (1 bar=$10^5$ Pa) above ambient pressure.

In the preferred embodiment of drying element $\mathbf{41}_k$ or jet (beam) source $\mathbf{41}_k$ and the positioning thereof in printing unit 11; 21 or in inking and/or dampening unit 17, 18; 17; 18,—at least under defined operating conditions for the operating medium being used, e.g. an operating pressure listed below—a normal distance $a_N$, i.e. the distance from the jet (beam) center of the drying element $\mathbf{41}_k$ that forms the jet (beam) source along the mean jet (beam) direction to the point of incidence on surface F to be treated, forms an angle $\alpha 1$; $\alpha 2$ with a peripheral jet (beam) extending from the jet (beam) center to the section end of axial section $a_j$ of e.g. at least 20°, in particular at least 25°, and/or no more than 50°, in particular no more than 45°, so that a jet (beam) angle $\alpha$ of at least 40° and/or no more than 100°, in particular at least 50° and/or no more than 90°, will be or is formed. The jet (beam) angle $\alpha$ is understood in this case, e.g. as the angle between the two peripheral jets (beams) proceeding from the exit point of the central jet (beam) and bordering the axial section $a_j$ in the axial direction, with the central jet (beam) being understood, e.g. as the jet (beam) that lies at the area centroid of the jet (beam) cross-section S exiting drying element $\mathbf{41}_k$. The peripheral jet (beam) in this context is considered to be the jet (beam) path from the jet (beam) center to the section end in the case of a sharp-edged jet (beam) profile, and is considered to be the path from the jet (beam) center to the 50% value in the case of a gentler drop in the jet (beam). The jet (beam) center in this case can be regarded as the center of the jet (beam) width $b_B$ at the level of the jet (beam) outlet, as viewed in the axial direction. The divergence of the jet (beam) S—particularly when combined with a variation in the activation pattern and/or in the operating pressure, as described in greater detail below—enables a finer gradation in the influence on the dampening profile.

For the embodiment of drying element $\mathbf{41}_k$ as a blowing element $\mathbf{41}_k$, the jet angle $\alpha$ described here refers to the presence, at a distance that corresponds to the normal distance for a specified operating pressure, for example, of between 1 and 6 bar, preferably between 2 and 5 bar, in particular 3.0 bar above ambient pressure.

In the following embodiments, the device and the method for adjusting and/or modifying a profile in the supply of dampening medium, extending in the direction of the printing width, will be described in reference to the preferred embodiment of drying elements $\mathbf{41}_k$ or jet sources $\mathbf{41}_k$ embodied as blowing elements $\mathbf{41}_k$, in which individual or overarching principles—where the respective teaching is not directed specifically to the embodiment comprising drying elements $\mathbf{41}_k$ embodied as blowing elements $\mathbf{41}_k$—are to be applied generally to other embodiments, and also individually to other embodiments with respect to the activation and/or intensity of adjustable drying elements $\mathbf{41}_k$, e.g. to the embodiment as electromagnetic beam sources $\mathbf{41}_k$.

To form the active sections $\alpha_i$ that make up the individually influenceable axial sections $a_j$ during operation, the number of I drying elements $\mathbf{41}_k$, in particular blowing elements $\mathbf{41}_k$, are arranged side by side as viewed in the axial direction of the printing unit cylinders and/or the dampening and/or inking unit rollers of the printing unit 11; 21, for example, on a single-part or multipart cross-member 42, which is mounted, for example, at both ends—where appropriate via coupling means not described in detail—each in a single-part or multipart side frame 43; 44 of printing unit 11; 21 or printing unit assembly 03.

To be able to remove dampening medium by section from the inking and/or dampening unit 17, 18; 17; 18, the group of drying elements $\mathbf{41}_k$ or the drying device 39, in particular the blowing device 39, that comprises these elements may be arranged so as to cooperate with the lateral surface of any rotational body 12; 13; 14; 19; 23; 24; 26; 27; 33; 34; 36 that conveys inking and/or dampening medium on its lateral surface from the relevant inking and/or dampening unit 17, 18; 17; 18. It is advantageously arranged in printing unit 11; 21 or printing unit assembly 03 so as to cooperate with the lateral surface of the printing unit cylinder 13; 19, more particularly embodied as forme cylinder 13; 19, that cooperates with the inking and/or dampening unit 17, 18; 17; 18 in question for the inking up and/or wetting thereof, or so as to cooperate with a roller 23; 24; 26; 27; 33; 34; 36 of the inking and/or dampening unit 17, 18; 17; 18 in question.

In principle, a plurality of such drying devices 39 or groups of drying elements $\mathbf{41}_k$ may also be provided in a plurality of locations in the inking and/or dampening unit 17, 18; 17; 18 up to the relevant printing unit cylinder 13; 19—depending on the choice of roller train and/or the positioning along a roller train.

Although in one variant, the drying device 39 may, in principle, be arranged so as to also cooperate with a roller 33; 34; 36 that lies in the roller train of the flow of dampening medium extending directly to the printing unit cylinder 13; 19, in a preferred embodiment it is arranged so as to cooperate with a roller 24; 26 that is preferably different from dampening and ink forme rollers 27; 36 and lies in the flow of ink downstream.

For the advantageous case, described here by way of example, of a roller train that is divided downstream at one of the inking rollers into two roller trains, the drying device 39 can advantageously be arranged so as to cooperate with a roller 24 which is assigned to the as yet undivided strand of rollers of inking unit 17. This may preferably be the roller 24 that forms nip points with the first rollers of at least two roller trains that branch off, and/or the roller 24 of the as yet undivided strand of rollers that lies closest in the roller train, in terms of the flow of ink, to the printing unit cylinder 13; 19 that is to be inked up.

In a particularly advantageous embodiment, drying device 39 may be arranged so as to cooperate with a roller 24 from which the printing ink is to be transferred downstream along the shortest possible fluid path via only two rollers 26; 27, for example, a distribution roller 26 and a forme roller 27; 36, to the printing unit cylinders 13; 19 to be inked up.

For one, multiple, or all of the aforementioned embodiments and refinements, it may be particularly advantageous for drying device 39 to be arranged so as to cooperate with a roller 24; 33 that has a "soft" surface and/or with a roller that is different from forme rollers 27; 27.

For one, multiple or all of the aforementioned embodiments and refinements, it may be particularly advantageous for drying device 39 to be arranged so as to cooperate with a roller 24; 26 of the roller train that lies in the flow of ink—in contrast to a so-called rider roller—, i.e. with a roller 24; 26 that forms a nip point in each case with at least one roller on the upstream side and at least one roller 24; 26 on the downstream side.

In an advantageous embodiment of one, multiple or all of the aforementioned embodiments and refinements, drying device 39 comprises a number I of drying elements $\mathbf{41}_k$, more particularly blowing elements $\mathbf{41}_k$, side by side that corresponds at least to the number m of ink zones $z_i$, i.e. I≥n. Advantageous in this case is an arrangement in which the number I=m or in which the number m of I>m blowing elements $\mathbf{41}_k$ are arranged and configured in such a way that the sectional plane of each of the m active sections $a_i$, which are formed side by side during operation by these m blowing elements $\mathbf{41}_k$, which sectional plane bisects the active width $b_i$ perpendicular to its axial extension in a 1:1 allocation, intersects with a zone width $b_z$ of the m ink zones $z_i$, with which the respective ink zone $z_i$ coincides, preferably substantially or nearly, e.g. with at most a deviation of ±20%, in particular at most ±10% of the zone width $b_z$ in question, perpendicular to its extension in the bisecting sectional plane. In a particularly preferred embodiment, the jet centers of the blowing elements $\mathbf{41}_k$ are aligned with the sectional planes that bisect the respective ink zones $z_i$ perpendicular to their widthwise extension.

In principle, however, a division into sections other than the 1:1 allocation is also possible between the m inking unit zones zi and the number of drying elements $\mathbf{41}_k$ lying within the alignment of the active width of the ink source 31, e.g. the ink fountain 31, provided by the total number of inking unit zones zi.

Figure 4:
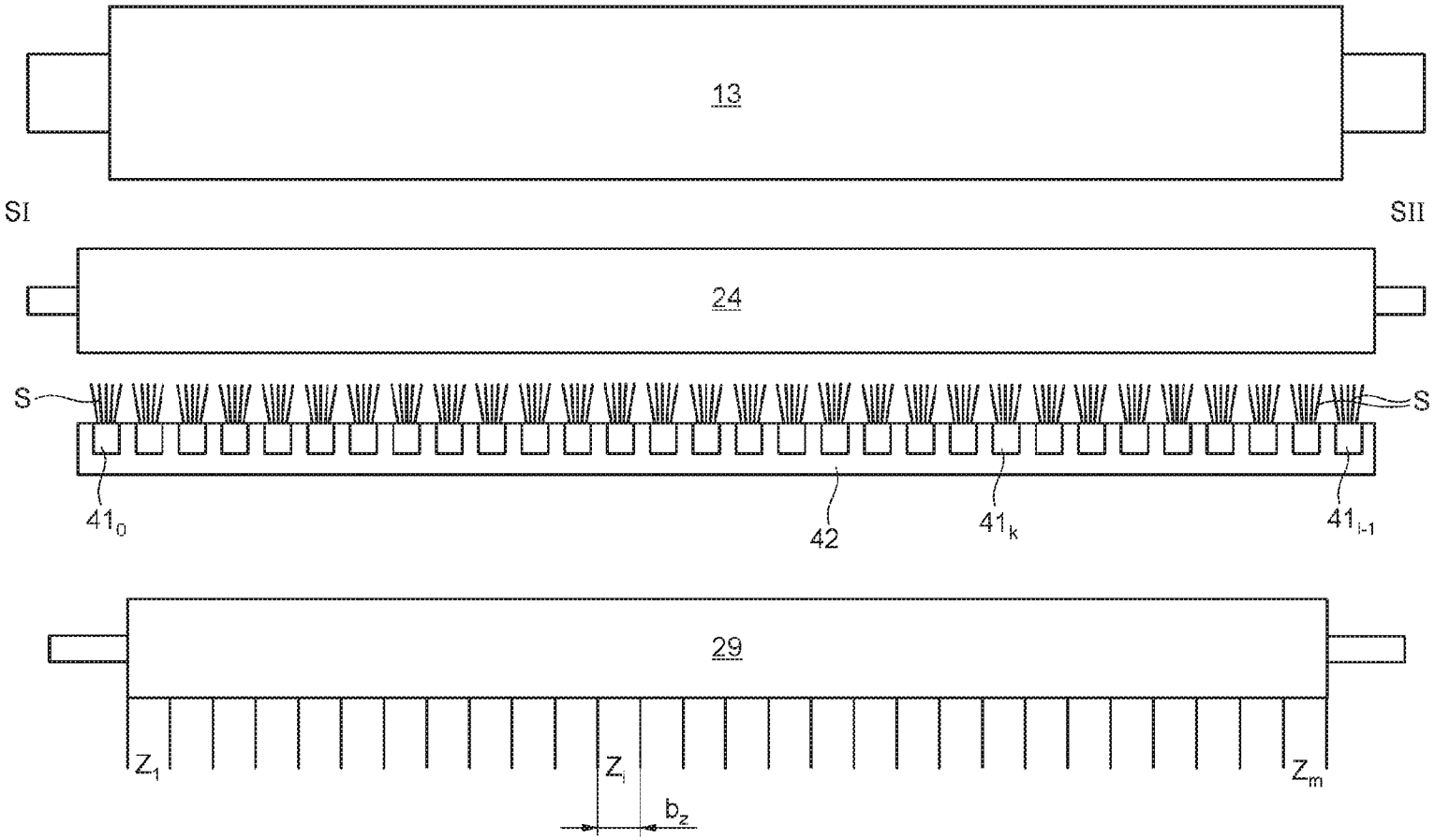
FIG. 4 a schematic diagram illustrating the arrangement of the device for adjusting and/or modifying a profile, which extends in the direction of the printing width, said device having a number of drying elements in the printing unit.
Figure 5:
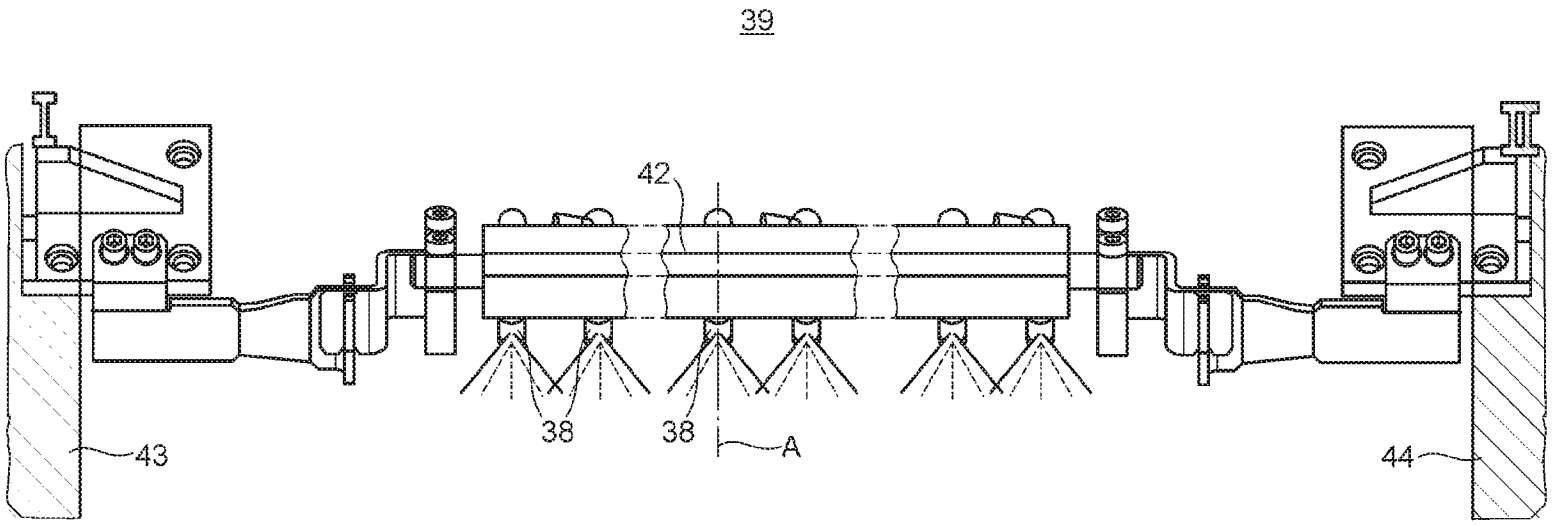
FIG. 5 a three-dimensional elevation view of an embodiment of a drying device configured as a blowing device.
Figure 6:
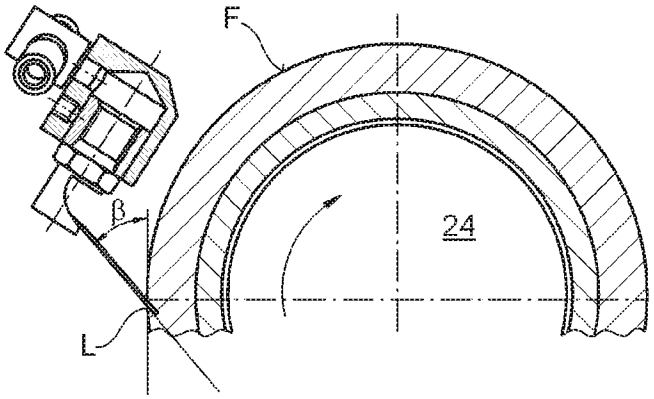
FIG. 6 a cross-section of a drying device cooperating with a rotational body, as shown in FIG. 5.
Figure 7:
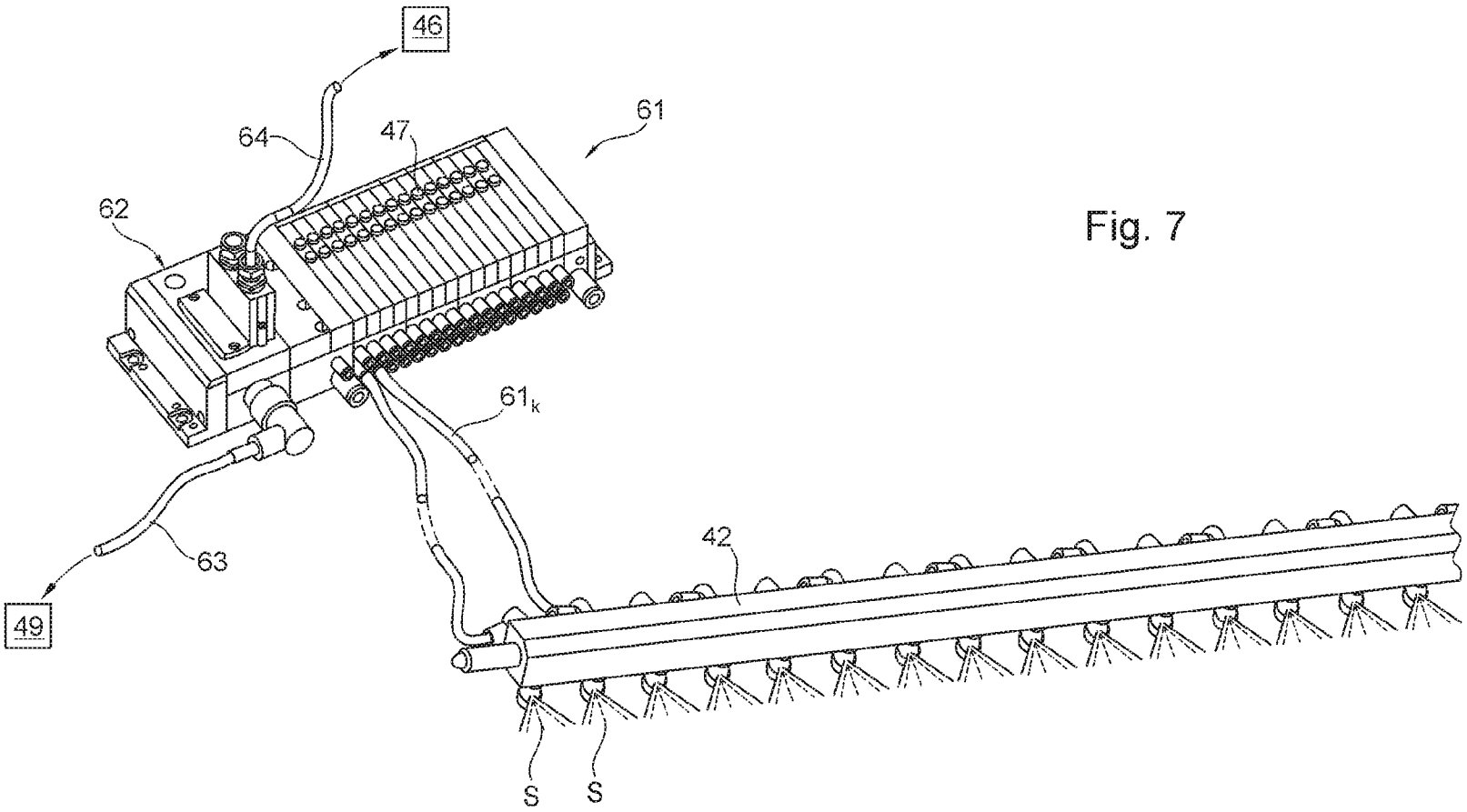
FIG. 7 a three-dimensional perspective view of an embodiment of a drying device configured as a blowing device and the supply thereof with operating medium.

In an advantageous refinement, the total of the active widths $b_j$ of the axial or active sections $a_i$ of a drying device 39 that can be treated by a group of n drying elements $\mathbf{41}_k$ may have a greater total active width than the total of the zone widths $b_z$ of the inking unit 17 assigned to the same inking and/or dampening unit 17, 18; 17; 18, which accounts, for example, for the ink/dampening medium profile that is widened by distribution in the inking and/or dampening unit 17, 18; 17, 18. This can be achieved, where appropriate, by making the active width $b_j$ greater than the zone widths $b_z$, and/or by means of a greater number I of active sections $a_i$ than the number of inking unit zones zi. In the advantageous embodiment described, along each edge in an axial region that extends beyond the alignment of the inking unit zones $z_i$, at least one additional drying element $\mathbf{41}_k$ (e.g. $\mathbf{41}_0$; $\mathbf{41}_{j-1}$ in FIG. 4) and/or one active section a; are provided. In addition to this, a greater active width $b_j$ than the zone widths $b_z$ may be provided, which, for example in the aforementioned case of a 1:1 allocation of the m of I drying elements $\mathbf{41}_k$ to m inking unit zones $z_i$, results in overlaps for the respectively adjacent active sections $a_i$; $a_{j+1}$.

In a preferred embodiment, drying elements $\mathbf{41}_k$ are embodied as flat-jet nozzles $\mathbf{41}_k$. In a particularly preferred embodiment, they may be embodied as a nozzle $\mathbf{41}_k$ in a deflector or baffle plate configuration, in particular as a tongue or spoon nozzle, in which case a fluid jet S first passes through an opening contained in drying element $\mathbf{41}_k$ and even before exiting drying element $\mathbf{41}_k$ is deflected from the previous direction to the desired direction and/or to the desired angular range about an angle of at least 45°, in particular 70° to 80° via a guiding or baffle element. The jet S is thereby expanded in a defined manner and exits the drying element $\mathbf{41}_k$ particularly in the form of a flat jet. The "exit" of drying element $\mathbf{41}_k$ is understood here as the point at which the jet S exits the guiding or baffle element in the direction of the surface F. In a straight-jet embodiment of a blowing element $\mathbf{41}_k$ embodied as a nozzle, the plane of the nozzle opening may be understood as the exit.

In an advantageous embodiment in which blowing elements $\mathbf{41}_j$ are embodied as nozzles, these are arranged as flowing at the same angle β, with respect to the jet axis A that is projected into a plane perpendicular to the rotational body axis, toward the surface F to be acted upon. The angle β is indicated, for example, as the angle of inclination of jet axis A, which is projected into the plane that is perpendicular to the rotational body axis, in relation to the tangent at the point of incidence. This is advantageously an angle ranging from 30° to 65°, in particular 40°±50°, and is preferably directed counter to the direction of rotation prevailing at the point of incidence during operation, as viewed in the direction of the jet. Blowing elements $\mathbf{41}_j$ are preferably arranged and aligned flush with one another in such a way that the jet axes A projected in the plane that is perpendicular to the rotational body axis lie on the same line I, e.g. effective incidence line L.

Independently, in principle, of the specific embodiment of drying elements $\mathbf{41}_k$ and/or the subdivision with respect to the inking unit zones zi, but advantageously in conjunction with an aforementioned embodiment as jet sources, in particular as blowing elements $41_k$, and/or in conjunction with a 1:1 subdivision in at least the alignment of the width of the ink infeed through ink source 31 that is used for inking, the dampening profile adjustment device comprises control means 46, 47$v$; 48, by means of which the number of I drying elements $41_k$ that can be adjusted independently of one another with respect to activation and/or intensity can be adjusted with respect to the activation, for example the switching on and off, of each drying element $41_k$ and/or with respect to the intensity of the action that can be achieved by each of the connected drying elements $41_k$, e.g. by adjusting the fluid pressure acting on each of the supply lines of the group of drying elements $41_k$ on the intake side, and/or with respect to the intensity of the action that can be achieved by each individual drying element $41_k$, e.g. by individually adjusting the fluid pressure acting on each individual drying element $41_k$ on the intake side.

In this case, the control means comprise a control device 46, which may be formed by an electronic circuit, a software program or a combination of the two, and/or may be implemented in a controller, e.g. in a machine controller, a control console computer or a control computer provided specifically for this purpose. Control device 46 is connected for signaling purposes to a number of switching and/or adjusting means $47_v$ (v=1, . . . , t with t∈ℕ , t>1, in particular t≥n, for example, t≥30) that corresponds to the number m of drying elements $41_k$ to be adjusted, and by means of which the m drying elements $41_k$ and/or the axial sections $a_j$ that can be treated therewith can be adjusted or varied independently of one another in terms of activation and/or intensity. The "variation" in this case is meant to comprise both an embodiment in which the drying elements 41$k$ are configured as switchable by means of respectively assigned binary switching and/or adjusting means $47_v$ between an "on" switching state and an "off" switching state, and an embodiment in which, beyond the two switching states "on" and "off", one or more discontinuous switching states therebetween or a continuous adjustment range therebetween are or is provided. The connection for signaling purposes may be formed by one or more corresponding signal lines, e.g. by a bus system or by a plurality of individual signal lines.

Each switching and/or adjusting means $47_v$ can be used to selectively activate and/or vary the intensity of the operating medium drying action in the axial or active section $a_i$, e.g. the supply of electric power necessary for generating electromagnetic radiation or preferably the volumetric flow of a gaseous fluid exiting the outlet of drying element $41_k$.

Figure 3:
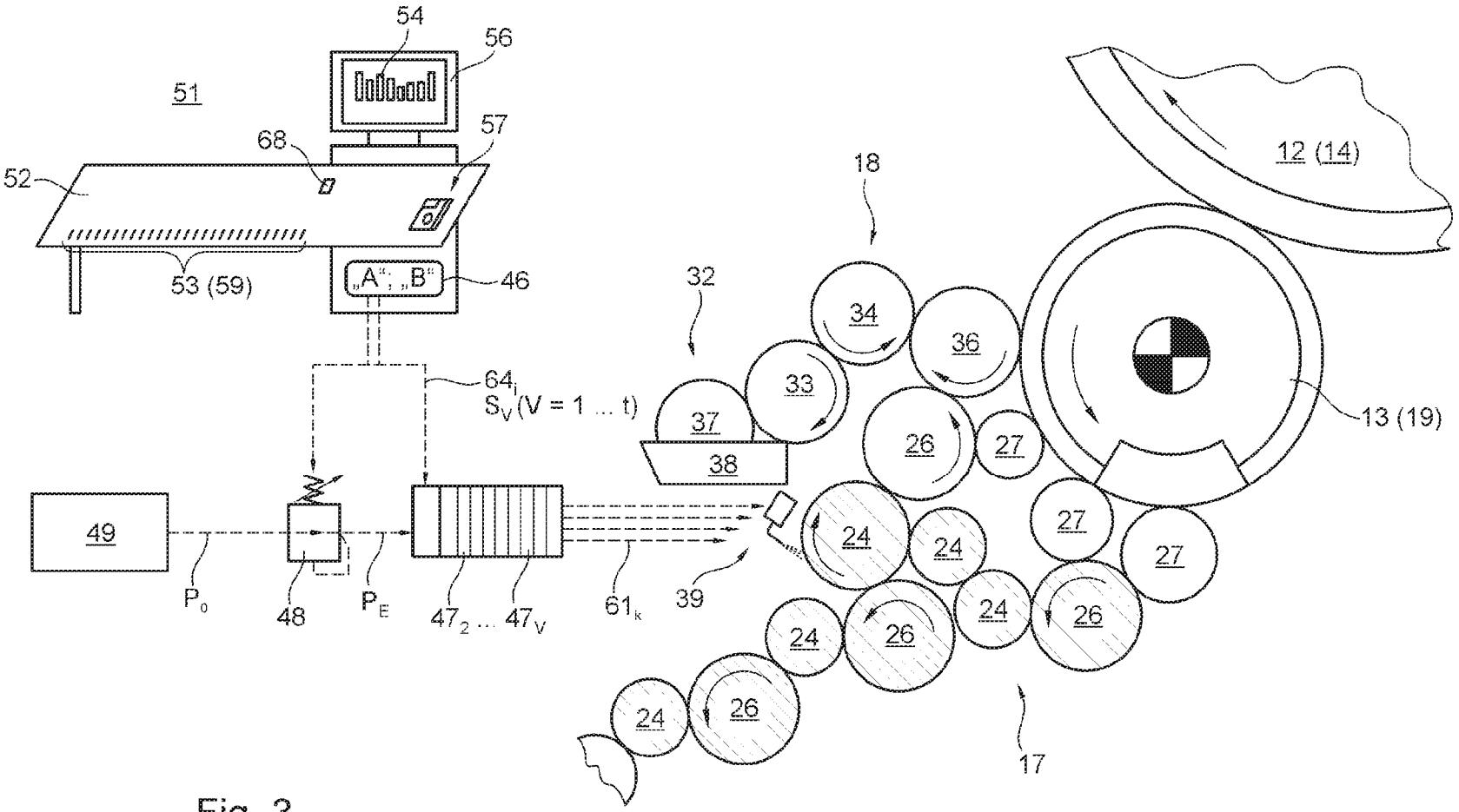
FIG. 3 an enlarged cut-out section of the exemplary embodiment of the printing unit assembly of FIG. 2 having a device for adjusting and/or modifying a profile in the supply of dampening medium that extends in the direction of the printing width.

The operating medium, e.g. the electric power or preferably the fluid flow, is supplied in each case between the switching and/or adjusting means $47_v$ and the drying elements $41_k$, in parallel via a number of lines $61_k$ that corresponds to the number m of drying elements $41_k$ and/or axial sections $a_j$ to be adjusted individually. The switching and/or adjusting means $47_V$, e.g. switchable valves $47_V$, may each be structurally adjacent to or combined with the drying element $41_k$ to which it is assigned, or as is shown e.g. in FIG. 3, may be arranged adjacent to one another centrally and/or in a common modular unit 58, e.g. a so-called valve island 58, with a common line 63 to the operating medium supply, a signal connection 64 to the control device 46, and a connection and/or control component 62 connected via signal connection 64 to control device 46. "Modular unit" in this case is understood as a unit comprising a plurality of functional components, which may be dismantled if necessary, but which can be installed in the system as a complete unit in a preassembled state and can be removed therefrom in this state, with the exception of the establishment or separation of necessary supply and/or fastening connections.

The operating medium to be adjusted by means of switching and/or adjusting means $47_V$, e.g. the electric power or preferably the pressurized fluid, can be supplied to all branches that can be adjusted via the switching and/or adjusting means $47_V$ from a common source 49 that supplies the operating medium, e.g. from a power unit or preferably from a pressurized fluid source 49 that stores and/or supplies a pressurized fluid.

In an advantageous embodiment, an additional switching and/or adjusting means 48, e.g. a valve 48 that can be switched between at least two active switching states that are different from one another and different from an inactive "zero" state, may be provided in the common supply line 63, and may be used to adjust e.g. all of the supply lines in the group of connected drying elements $41_k$, advantageously all of said drying elements that are allocated to the same drying device 39, or the switching and/or adjusting means $47_v$ assigned individually to these drying elements $41_k$ in terms of their operating medium potential present at least on the intake side and determining the level $P_E$ of jet power that can be achieved, e.g. for the preferred case of blowing elements $41_k$, the pressure level $P_E$, in particular the fluid pressure present on the intake side at the individual switching and/or adjusting means $47_V$. This level $P_E$ that can be adjusted at the central switching and/or adjusting means 48—for example, in the adjustment range up to the height of the base level $P_0$ supplied by the source—correlates, for example, with a maximum value for an adjustment range to be adjusted in discrete steps or continuously by means of the individual switching and/or adjusting means $47_V$ disposed downstream, or to an actual value for the jet power that is present when a binary switching and/or adjusting means $47_V$ is in the active "on" switching state. If switching and/or adjusting means 48 is fully open or if no such means is provided, the intake-side level $P_E$ present at the individual switching and/or adjusting means $47_V$ corresponds to the base level $P_E$ that is supplied—with the exception of any line losses that may result from line resistance, in this case resistance-based line losses presupposed as negligible.

In the case of blowing elements $41_k$, switching and/or adjusting means 48 may preferably be embodied as a valve 48 that is switchable e.g. between at least two switching states that are different from one another and from "zero", advantageously as a continuously adjustable valve 48, in particular as a proportional valve 48 and/or servo valve 48.

In the aforementioned case in which one modular unit 58 comprises the individual switching and/or adjusting means $47_V$ of a group of or all of the drying elements $41_k$ of drying device 39, switching and/or adjusting means 48 may likewise be provided as part of said modular unit, arranged upstream in supply line 63 as a separate component, or structurally integrated into a modular unit that forms or comprises source 49.

Figure 11:
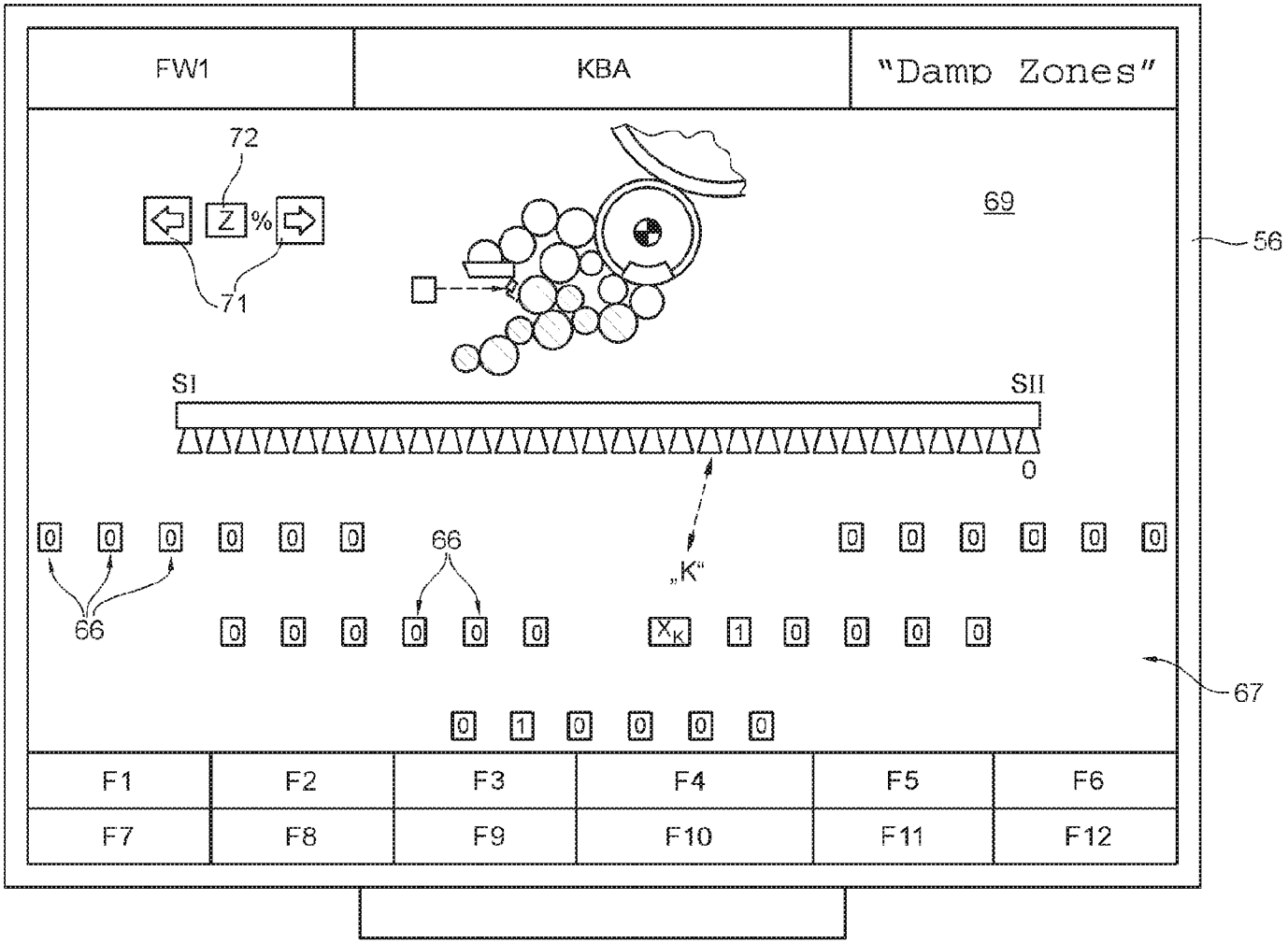
FIG. 11 a schematic diagram of a first embodiment of a selection display or screen having control elements for adjusting a removal of dampening medium in axial sections.
Figure 12:
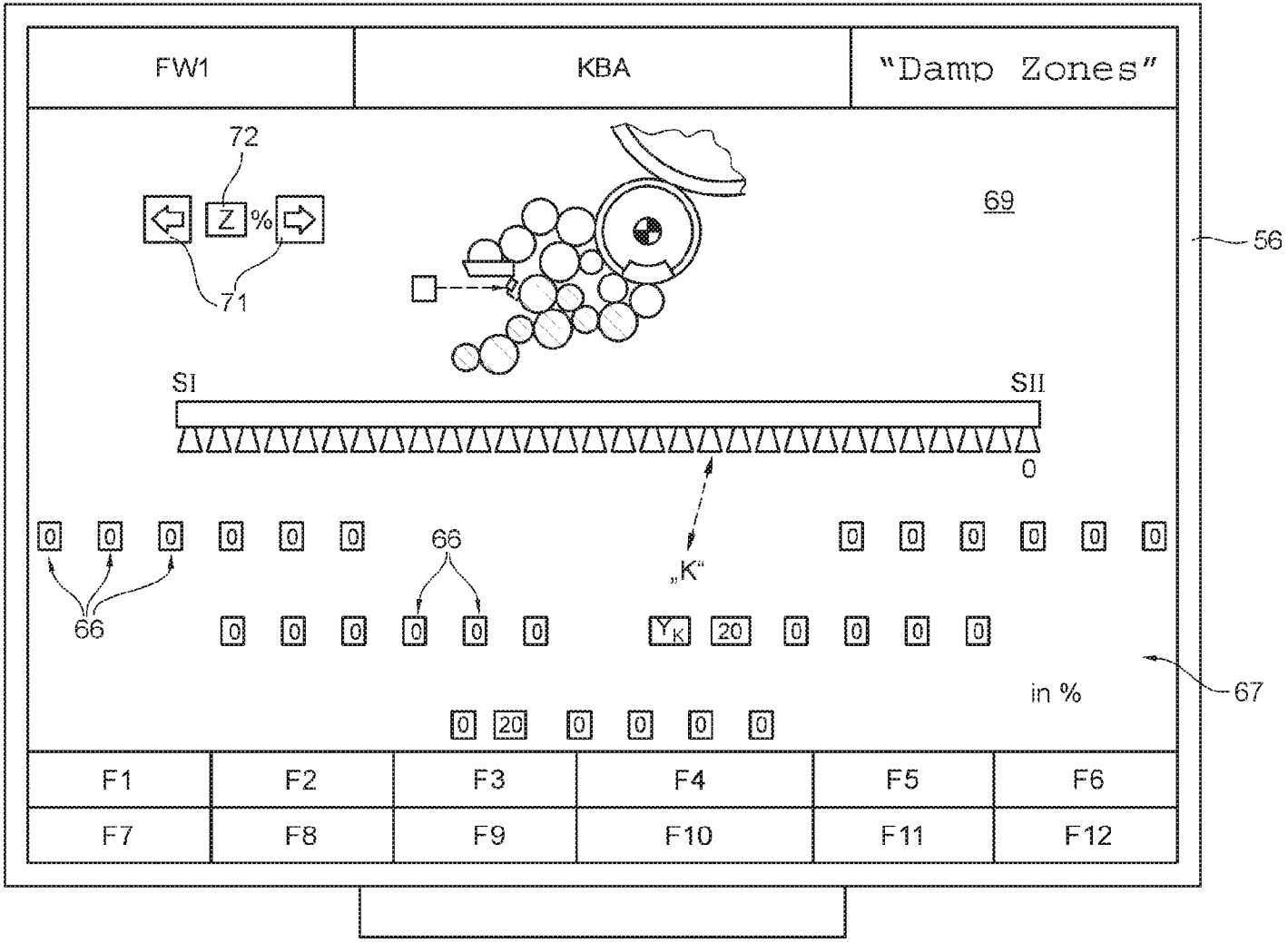
FIG. 12 a schematic diagram of a second embodiment of a selection display or screen having control elements for adjusting a removal of dampening medium in axial sections.

Switching and/or adjusting means $47_V$ can be adjusted, in particular by remote actuation, via control elements 66 of an operator interface, for example an operator interface provided on control panel or control console 51. In one embodiment, not shown, a group 67 of such control elements 66 that are and/or can be assigned in terms of circuitry to switching and/or adjusting means $47_V$—similarly to and optionally in addition to the control elements 59 acting on inking unit zones $z_i$—can be provided as integral keys or buttons 66 or as pairs of keys or buttons on the delivery table 52 that is used for inspecting printed products. In one alternative, an additional control element 68, embodied, for example, as a key or button, may be provided in the access handle portion of the operator interface; when actuated, said additional element assigns the or at least some of the control elements 59 provided for ink zone adjustment in terms of circuitry to switching and/or adjusting means $\mathbf{47}_v$ as control elements 66 for adjusting drying elements $\mathbf{41}_k$ and/or axial sections $\mathbf{41}_k$. In a further embodiment schematically illustrated, e.g. in FIG. 11 and FIG. 12, control elements 66 or the group 67 of control elements 66 may be embodied as manipulable fields in a selection screen 69 on a display 56 configured for numerical and/or graphic visualization of each ink zone adjustment. In that case, the fields that represent the control elements 66 may be displayed on the same screen as those of the ink zone adjusting elements, or on a different screen 69. Manipulation may be carried out using control elements of the or of a control unit 57 that interacts with the fields of the selection screen, and in the case of a contact-sensitive and/or touchscreen enabled embodiment of display screen 56, may be carried out where appropriate by direct interaction with correspondingly provided display screen areas, or in combined form by manipulating the field that represents the axial section $a_j$ in question on display screen 56 and by manipulating the setting on control unit 57.

Remotely controlled adjustment in this context—contrary to an individual adjustment on site—means that the control elements 66 may be adjusted centrally in the area of the same user interface, and not merely individually using mechanical or electrical control elements that are provided in a decentralized manner for each of the switching and/or adjusting means along the row of axial sections $a_i$.

Control device 46 is at least embodied for implementing in a defined manner control commands input by press operators at the operator interface via control elements 66 for one or more axial sections $a_j$ and/or drying elements $\mathbf{41}_k$, e.g. control pulses, input commands or value changes triggered using the control elements, by actuating the switching and/or adjusting means $\mathbf{47}_v$ in question.

In an example, which is not a part of the invention, of the configuration and arrangement of the independently adjustable axial sections $a_j$ (see, e.g. FIG. 9), the embodiment of drying elements $\mathbf{41}_k$, in particular blowing elements $\mathbf{41}_k$, the arrangement of drying elements $\mathbf{41}_k$, in particular blowing elements $\mathbf{41}_k$, relative to one another and relative to the surface F of rotational body 12; 13; 14; 19; 23; 24; 26; 27; 33; 34; 36, and/or the existing jet angle α are configured such that multiple or all of the adjacent active or axial sections $a_j$ arranged offset relative to one another in the direction of the printing width substantially adjoin one another, i.e. they have no overlap, or they have an overlap of less than 20%, in particular less than 10% of the active width bj with one another. This condition is met, for example, at a preferred operating pressure and/or at a distance corresponding to the normal distance, with the operating pressure in this case being, for example, between 1 and 6 bar, preferably between 2 and 5 bar, in particular at 3.0 bar above ambient pressure. If the jet profile is not sharp-edged in the axial direction, then the above definition for the respective active width $b_j$—namely, the length of the active or axial section $a_j$ in the axial direction between the two 50% end values—may be applied.

In an embodiment according to the invention of the configuration and arrangement of the independently adjustable axial sections $a_j$ (see, e.g. FIG. 10), the embodiment of drying elements $\mathbf{41}_k$, in particular blowing elements $\mathbf{41}_k$, the arrangement of drying elements $\mathbf{41}_k$, in particular blowing elements $\mathbf{41}_k$, relative to one another and relative to the surface F of the rotational body 12; 13; 14; 19; 23; 24; 26; 27; 33; 34; 36, and/or the existing jet angle α are configured such that multiple, but preferably all adjacent active or axial sections $a_j$ that are arranged offset relative to one another in the direction of the printing width overlap one another in pairs significantly, i.e. by at least 20%, in particular at least 30%, and preferably 40% to 60% of their width $b_i$ with an adjacent axial section $a_j$—e.g. at least calculated from at least one of the two ends of axial section $a_j$. This condition is met, for example, at a preferred operating pressure and/or at a distance corresponding to the normal distance, with the operating pressure in this case being, for example, between 1 and 6 bar, preferably between 2 and 5 bar, in particular at 3.0 bar above ambient pressure. If the jet profile is not sharp-edged in the axial direction, then the above definition for the respective active width $b_i$ may also be applied here.

In a variant, not shown, of the configuration and arrangement of the independently adjustable axial sections $a_j$, the embodiment of drying elements $\mathbf{41}_k$, in particular blowing elements $\mathbf{41}_k$, the arrangement of drying elements $\mathbf{41}_k$, in particular blowing elements $\mathbf{41}_k$, relative to one another and relative to the surface F of the rotational body 12; 13; 14; 19; 23; 24; 26; 27; 33; 34; 36, and/or the existing jet angle α are configured and acted on by an operating medium such that, in a first operating situation, multiple or all adjacent active or axial sections $a_j$ that are arranged offset relative to one another in the direction of the printing width are spaced from one another or substantially adjoin one another when a first, e.g. lower of two different operating pressures is applied, i.e. they do not overlap, or at most they overlap one another by less than 20%, in particular less than 10% of their active width and in a second operating situation, when a second, e.g. higher of the two different operating pressures is applied, they overlap one another in pairs significantly in a manner according to the invention, i.e. by at least 20%, in particular by at least 30%, preferably by 40% to 60% of their width $b_j$ with an adjacent axial section $a_j$. This condition is met, for example, at the operating pressure in each case at a distance that corresponds to the normal distance, with the first and second operating pressures each, for example, lying between 1 and 6 bar, preferably between 2 and 5 bar, with the proviso that the second operating pressure is greater than the first. In this case as well, if the jet profile is not sharp-edged in the axial direction, the aforementioned definition for the active width $b_j$ may be applied.

In the configuration and arrangement, according to the invention, of the independently adjustable axial sections $a_j$ or in the operating situation of the third configuration and arrangement with significant overlap, it is possible during operation to produce and/or form one or more sections "2 I" that are treated simultaneously by two adjacent drying elements 41*k*, and one or more sections "I" that are treated by only one drying element 41*k* and/or one or more untreated sections "–" over the active width that is covered by drying device 39, by alternatingly activating different selections in each case of one or more of the I drying elements 41*k* or by activating these elements at the same time. For purposes of illustration, in FIG. 11, by way of example, drying elements $\mathbf{41}_k$ and $\mathbf{41}_{k+1}$ are activated or the switching and/or adjusting means thereof are placed in the "on" switching state, while drying elements $\mathbf{41}_{k-1}$ (only alluded to here) and $\mathbf{41}_{k+2}$ are deactivated or the switching and/or adjusting means thereof are in the "off" switching state, In a first embodiment of the device with respect to the adjustment of drying elements $\mathbf{41}_k$—which may refer to all of the aforementioned embodiments relating to the arrangement and configuration of axial sections $a_j$ and/or to all of the aforementioned embodiments and refinements of drying elements $41_k$—the device for adjusting and/or modifying the axially extending dampening medium profile is configured to operate the drying elements $41_k$ and/or the switching and/or adjusting means $47_s$ assigned thereto between—in particular only—two switching states, specifically an active ("on") switching state and an inactive ("off") switching state. For this purpose, a signal that represents the "on" switching state and a signal that represents the "off" switching state may be applied by control device 46 via signal connection 64 to each of drying elements $41_k$ and/or to the switching and/or adjusting means $47_s$ assigned thereto, wherein one of these two signals may also be provided as the "zero signal", i.e. the signal level or shape that is present at the output in the idle state.

In view of the costs associated with this, for example, switching and/or adjusting means $47_s$ are preferably embodied in this case as switching and/or adjusting means $47_v$ that can be switched between at least two switching states, specifically between a switching state that effects a passive state and one that effects at least one active state of the drying element $41_k$ in question, preferably as switching and/or adjusting means $47_v$ that can be switched only between these two "on" and "off" switching states. They are embodied e.g. as electric on/off switches or more particularly as fluid valves $47_V$ that can be selectively opened and closed, by means of which, depending on the switching state present at the corresponding switching and/or adjusting means $47_V$ and assigned by controller A via control signal $S_V$, the supply with working medium, e.g. with electric power required for the radiation or preferably with a fluid flow required for the jet S, can be switched on or off. In this embodiment, switching and/or adjusting means $47_V$ are preferably embodied and/or actuated as switchable in binary fashion between an "on" switching state and an "off" switching state.

Drying elements $41_k$ or the switching and/or adjusting means $47_s$ assigned to these may be adjusted manually by press operators on an aforementioned operator interface, for example using the aforementioned control elements 66 and the control device 46—optionally selectively and in addition to an implemented adjustment routine, for example coupled with a zonal dampening medium measurement and/or with an ink zone adjustment. Parameters or modifications that are input by press operators for one or more axial sections $a_j$ and/or drying elements $41_k$ at the operator interface are then implemented in a defined manner by appropriate actuation of the switching and/or adjusting means $47_v$ concerned. For instance, one of the control elements 66 assigned in terms of circuitry to the axial sections $a_j$, e.g. the kth control element $66_k$, may be adjusted with respect to its value that represents the switching state by appropriately manipulating and/or modifying the control element 66 in question, for example the appropriate key 66 or the appropriate pair or keys or buttons 66, or the appropriate field in the selection display screen 69. In the case of the first embodiment, for the adjustment of the drying elements $41_k$, specifically between only the two switching states "on" and "off", switching may be implemented by pressing a button on an actual or virtual key 66, generated as a field on the screen, or by modifying a value $X_k$ that represents the intended switching state in a field 66 that relates to the specific drying element $41_k$ on a selection display screen 69. In a case of purely binary adjustment, adjustment may involve making a selection from a set of values consisting, for example, of only two values $X_k$, e.g. $X_k \epsilon \{0, 1\}$, in which case, in place of other types of expressions, the value 0 for an inactive and the value 1 are displayed (see, e.g. FIG. 11).

In an advantageous refinement in which an aforementioned central switching and/or adjusting means 48 is provided, for example, in addition to the binary adjustment of drying elements $41_k$ and/or the switching and/or adjusting means $47_s$ assigned thereto, an adjustment of a level of the operating medium potential as described above, for example an adjustment of the pressure level for all or at least a plurality of the drying elements $41_k$ or switching and/or adjusting means $47_s$ supplied with operating medium via the same supply line 63, may be provided.

The central switching and/or adjusting means 48 situated upstream of the plurality of drying elements $41_k$ may be adjusted manually by press operators on an aforementioned operator interface by manipulating a control element 71, where appropriate via control device 46—optionally selectively and in addition to an implemented adjustment routine, for example coupled with a zonal dampening medium measurement and/or with an ink zone adjustment. Parameters or modifications that are input by press operators at the operator interface for a variable representing the level of operating medium and thus the maximum action of the jet power in question are then implemented by correspondingly actuating the switching and/or adjusting means 48 in a defined manner. For adjustment, an control element 71 embodied e.g. as a pair of keys or buttons 71 may be provided and actuable on the delivery table or in the control panel 57 or in a relevant field 71 in a specially designed or an aforementioned selection display or screen 54; 69, for example, by means of which the height of the level can be adjusted by manipulating an actual or virtual key 71 and/or by inputting or modifying a value Z that represents the level height, e.g. a percentage of the maximum possible level, in a field 72, a display and/or input field 72, or the selection display screen 54; 69 (see, e.g. FIG. 11 and FIG. 12).

In a second embodiment of the device with respect to the adjustment of drying elements $41_k$—which may relate to all of the aforementioned statements regarding the arrangement and configuration of axial sections $a_j$ and/or all of the aforementioned embodiments and refinements of drying elements $41_k$—the device for adjusting and/or modifying the axially extending dampening medium profile is configured for shifting the action relating to a circumferential section of the cooperating rotational body in an axial section, e.g. the jet power acting on a circumferential section of the cooperating rotational body, not only between the two boundary switching states, e.g. a state corresponding to a maximum value that corresponds to the maximum jet power provided for application, and an inactive state that represents a jet power of zero, e.g. when the drying element $41_k$ is switched off, but also to one or more additional discrete states or to states of a continuous adjustment range for the jet power lying therebetween. For this purpose, corresponding signals $S_V$ or signal sequences $S_V$ that represent these switching states are applied to drying elements $41_k$ or to the switching and/or adjusting means $47_s$ assigned thereto.

The drying elements $41_k$ assigned to the axial sections for the removal of the dampening medium or the switching and/or adjusting means $47_s$ assigned thereto can therefore each be varied individually in terms of the extent of their influence, averaged over time or area, between an inactive operating state, an active operating state that represents a maximum value, and at least one active operating state that assumes an intermediate value lying therebetween—in particular via control elements that can be manipulated by press operators and a control device that is connected for signaling purposes to the control elements.

In principle, the application of the intermediate values that lie between the boundary switching states "on" (="max") and "off" (="zero") for the aforementioned jet power per unit area to be applied can be achieved in various ways—for example by varying the amount of jet power per unit area (e.g., the radiant power per unit area in the case of electromagnetic radiation, or the mass flow per unit area in the case of a fluid flow S) or by varying the portion to be applied per unit of time or to be applied per circumferential section.

The aforementioned averaging over time of the extent of influence can thus also be understood as a mean value for the influence that results from the averaging over time—for a specific stationary operating state—, wherein in the case of a continuous and constant application, this value corresponds to the value of the application, for example the electromagnetic radiation applied per unit of time, e.g. per second, or preferably the applied volume of air, and in the case of a discontinuous, e.g. clocked application, this value corresponds to the mean value for the influence that results from the averaging over a full cycle, for example the electromagnetic radiation applied during the cycle, or preferably the volume of air applied. For both the continuous and the discontinuous case, this value represents the "power" of the electromagnetic beam or the fluid jet that is present in the relevant operating state. In a possible alternative embodiment involving a different type of influence, e.g. a mechanical influence of a doctor blade or removal device, this value averaged over time may be understood in the general sense of a measurement of the influence over time as "influence power". In parallel with this, averaging over area can be understood as a mean value of influence that results from the averaging over a surface area being treated by drying element $\mathbf{41}_k$—for a specific stationary operating state—, wherein in the case of a continuous and constant application, this value corresponds to the value of the application, for example the electromagnetic radiation applied per unit of surface area, e.g. per $m^2$, or preferably the applied volume of air, and in the case of a discontinuous, e.g. clocked application, this value corresponds to the mean value of the influence resulting from the averaging over the surface area treated during a full cycle, for example the electromagnetic radiation applied to this surface area treated during the cycle, or preferably the volume of air applied. For both the continuous and the discontinuous case, for the case in question here of a relative speed between drying element $\mathbf{41}_k$ and surface area F to be treated, the value per unit of time and the value per unit of surface area can be combined for the degree of influence, with knowledge of the active width $b_j$ and relative speed.

In a first embodiment, in which binary switching and/or adjusting means $\mathbf{47}_V$ can be used as switching and/or adjusting means $\mathbf{47}_V$, for example, application is carried out with one or more intermediate values for jet power by varying the portion to be impinged in the circumferential section in question by clocking the application, i.e. by means of a clocked jet, also referred to as a pulsed jet S. On a circumferential section of the cooperating rotational body, the drying element $\mathbf{41}_k$ in the relevant axial section $a_j$ alternately emits a jet S in the "on" switching state during a first time interval, and during a second time interval, in the "off" switching state, the drying element does not emit a beam S, wherein the time intervals may correspond with one another or may differ from one another. The jet power applied to the circumferential section in axial section $a_j$, for example, can be varied depending on the ratio of the adjustable intervals.

For this purpose, in control device 46 a control logic "A" may be implemented e.g. as electronic circuit "A" and/or as algorithm "A", by means of which the desired level—adjusted, for example, by the press operator at the operator interface—of the jet power to be applied for the axial section $a_j$ in question or an averaged or effective switching state that expresses this jet power, can be processed to obtain a correspondingly clocked signal, in particular a correspondingly clocked sequence of signals $S_V$ for application to the drying element $\mathbf{41}_k$ in question or to the switching and/or adjusting means $\mathbf{47}_s$ assigned thereto. In the case of drying elements $\mathbf{41}_k$ configured as blowing elements, during the interval operated in the "on switching state, for example, in which switching and/or adjusting means $\mathbf{47}_s$, e.g. valve $\mathbf{47}_v$, is open, the stream of fluid S flows out, whereas during the interval operated in the "off" switching state, no fluid S flows out.

Thus by means of control device 46, multiple or all of the drying elements $\mathbf{41}_k$ are and/or can be operated individually in principle, i.e. in principle in the clock frequency and/or the phase fractions between "on" and "off"—differently from one another and/or independently of one another, clocked between an "off" switching state and an "on" switching state. Clocking in this case does not refer to on or off switching processes, such as occur during a change from one setting to another setting for the action to be achieved, but to the clocking in on/off modulation that is necessary to achieve a certain adjustment of the effect to be achieved on average—that is to say, higher frequency clocking. Thus one control device 46 is or can be used to operate multiple or all of drying elements $\mathbf{41}_k$ in one of the active operating states, in each case individually clocked between an "off" switching state and an "on" switching state.

A clocking frequency for running through a cycle between the change to the "on" switching state up to the subsequent change to the next "on" switching state can be correlated with the machine speed of the printing unit, i.e. directly or indirectly with the rotational frequency of one or more of the rotational bodies 12; 13; 14; 19; 23; 24; 26; 27; 33; 34; 36 of the forme cylinder 13; 19 of the printing unit 11; 21 to be inked up, e.g. with this rotational body 12; 13; 14; 19; 23; 24; 26; 27; 33; 34; 36 itself or with a component or drive that is rotationally coupled thereto, or with a mechanical or electronic master axis. The clocking frequency in this case may be variable e.g. between 0 cycles per revolution of the forme cylinder and 100, or even 500 cycles per revolution of the forme cylinder. Preferably, the frequency is at least one cycle per revolution of the one printing unit cylinder of the printing unit in question which is embodied as forme cylinder 13; 19. In an advantageous refinement, in particular for cycle numbers of e.g. fewer than 20 cycles per revolution of the forme cylinder, the number of cycles per revolution of the forme cylinder in each case is not selected or adjusted in whole numbers.

In any case, the clocked or pulsed switching on and off of an active operating situation is to be understood as a stationary active switching state of the Is drying elements $\mathbf{41}_k$ in question, and is not to be confused with the switching on and off of one or more drying elements $\mathbf{41}_k$, such as occurs during a change from one operating situation to another. The pulsed or clocked switching on/off is thus carried out for a stationary active operating situation of the printing unit with a stationary cycle length and/or frequency. Although this may be modifiable for adjustment purposes, for example, during stationary operation of the printing unit, it is returned to an active "stationary pulsed" switching state.

In principle, the phase components may be symmetrically distributed, i.e. 50%:50%, but are advantageously variable or varied at least within a range of between 30%:70% and 70%:30%, preferably even between 20%:80% and 80%:20%, based on the ratio of the "on":"off" phase lengths.

In a second embodiment, provided or to be provided in place of the first embodiment or optionally selectively or in combination therewith, impingement is carried out with one or more intermediate values for the jet power by varying the intensity of the jet power delivered by drying element $\mathbf{41}_k$ in relation to a unit of area of the impinged surface F. Drying element $\mathbf{41}_k$ then applies, in one operating situation, for example, a jet (beam) S having, for example, a first power—e.g. a first beam power in the case of electromagnetic radiation or a fluid jet S with a first mass flow rate—to a circumferential section of the cooperating rotational body, in the axial section $a_j$ in question, and in an operating mode different from the first said drying element applies a jet (beam) having e.g. a higher energy beam power than the first beam power—e.g. more intense electromagnetic radiation, or a fluid jet with a greater mass flow rate. Depending on the adjusted jet (beam) power, the total jet (beam) power applied in axial section $a_j$ also varies over the circumferential section.

For this purpose, in the case of the provision of the jet (beam) as blowing elements and configured, for example, as having switching and/or adjusting means $\mathbf{47}_V$, a switching and/or adjusting means $\mathbf{47}_V$ that can be shifted into more than two discretely defined switching states, preferably a switching and/or adjusting means $\mathbf{47}_V$ having a continuous adjustment range is provided, to which the controller can apply corresponding signals $S_V$, in particular control signals $S_V$. In the case of drying elements $\mathbf{41}_k$ embodied as blowing elements, a continuously adjustable valve $\mathbf{47}_V$, in particular a proportional valve $\mathbf{47}_V$, for example, is provided as switching and/or adjusting means $\mathbf{47}_V$. In control device 46 in this case, a control logic "B" may be implemented, e.g., as an electronic circuit "B" and/or as an algorithm "B", by means of which the desired switching state adjusted for the axial section $a_j$ in question—for example, by the press operator at the operator interface—is processed to the associated control signal $S_V$ for application to the drying element $\mathbf{41}_k$ in question or the switching and/or adjusting means $\mathbf{47}_s$ assigned thereto.

In a refinement that is advantageous for both embodiments, in which, for example, an aforementioned central switching and/or adjusting means 48 is provided, in addition to the adjustment—for example clocked or to be clocked and/or varied or variable in terms of intensity—of the drying elements $\mathbf{41}_k$ and/or the switching and/or adjusting means $\mathbf{47}_s$ assigned thereto, an adjustment of a level of the operating medium potential in the above described sense, for example an adjustment of the pressure level $P_E$ present on the intake side for all or at least multiple of the drying elements $\mathbf{41}_k$ or switching and/or adjusting means $\mathbf{47}_s$ that are supplied with operating medium via the same supply line 63, may also be provided.

For both of these embodiments, drying elements $\mathbf{41}_k$ or the switching and/or adjusting means $\mathbf{47}_s$ assigned thereto may be adjusted manually—optionally selectively and in addition to an implemented adjustment routine, for example coupled with a zonal dampening medium measurement and/or with an ink zone adjustment—by press operators at an aforementioned operator interface, also using the aforementioned control elements 66 and control device 46 in this case, for example. Parameters or modifications that are input by press operators for one or more axial sections aj and/or drying elements $\mathbf{41}_k$ at the operator interface are then implemented in a defined manner by appropriate actuation of the switching and/or adjusting means $\mathbf{47}_V$ concerned. For instance, one of control elements 66 assigned in terms of circuitry to axial sections $a_j$, e.g. the kth control element $\mathbf{66}_k$, may be adjusted with respect to its value that represents the switching state by appropriately manipulating the control element 66 in question, for example the appropriate key 66 or the appropriate pair of keys or buttons 66, or the appropriate field in the selection display screen 69, for an appropriate length of time and/or modifying the value of said control element. In the case of the second embodiment for the adjustment of the drying elements $\mathbf{41}_k$, specifically between more than the two switching states "on" and "off", switching may be implemented by pressing a button on an actual or virtual key 66, generated as a field on the display screen, for a longer time or an appropriate number of times, or by modifying a value $Y_k$ that represents the intended switching state in a field 66 on a selection display screen 69 that relates to the specific drying element $\mathbf{41}_k$. In this case involving more than simply a binary adjustment, during adjustment, a selection may be made from a set of values consisting, for example, of more than two values $y_k$ in greater or smaller increments, e.g. in single percentage increments or, for example, in 10% increments ($Y_k \epsilon \{0\%, 10\%, 20\% \ldots 100\%\}$, in which case the selected display is designed to represent different scale graduations and/or values (see, e.g. FIG. 12).

In addition to or independently of the above-described option in which press operators may influence the dampening medium profile by making an adjustment at the appropriate operator interface, a control circuit that acts on the switching and/or adjusting means $\mathbf{47}_V$ and is based on a zonal measurement of the conveyance of dampening medium and/or a test measurement of the printed product, and/or a control and/or regulation process that couples the adjustment in axial sections $a_j$ to an adjustment of inking unit zones $z_i$ with appropriate control or regulating means may also be provided.

While a preferred embodiment of a device and a method for one of adjusting and modifying a profile in the supply of dampening medium, extending in the direction of the printing width, and of a printing unit having a device for one of adjusting and modifying the profile has been set forth fully and completely hereinabove, it will be apparent to one of skill in the art that various changes could be made without departing from the true spirit and scope of the subject invention which is accordingly to be limited only by the appended claims.

The invention claimed is:

1. A device for one of adjusting and modifying a dampening medium profile that extends in a direction of a printing width in a printing unit having at least one printing unit cylinder comprising:

at least a first inking unit for inking up the at least one printing unit cylinder;

at least a first dampening unit that cooperates with one of the at least one printing unit cylinder and the at least first inking unit; and a drying device extending over the printing width, the drying device being provided with a number of I ($I \epsilon \mathbb{N}$, $I>1$) drying elements, the influence of which drying elements on a surface of the printing unit to be treated allow dampening medium to be removed from a number of n ($n \epsilon \mathbb{N}$, $n>1$) axial sections $a_j$($j=1, \ldots, n$) of one of the at least first inking unit and dampening unit that are offset relative to one another in the direction of the printing width, an extent of the influence of which number of drying elements, with respect to the axial section ($a_j$) and the operating state of which drying elements can be varied independently of one another, wherein the drying elements are embodied and arranged in the printing unit such a way that at least 20% of a width ($b_j$), as seen in the direction of the printing width, of one of multiple and all of the axial sections ($a_j$), which are embodied as active sections ($a_j$) each having an active width ($b_j$), of the drying elements in the printing unit over an extension of each of said sections, overlaps with an adjacent axial section of adjacent axial sections ($a_j$), which are axially offset relative to one another in the direction of the printing width.

2. The device according to claim 1, wherein a control device and one of a switching device and an adjusting device, which are connected to the control device for signaling purposes, are provided, by the use of which, the one of multiple and all of the drying elements one of can be and are operated during a stationary active operating state such that each of the drying elements is pulsed, to be individually clocked between an "off" switching state and an "on" switching state.

3. The device according to claim 1, wherein the drying elements are each embodied and arranged in the printing unit such that 40% to 60% of the width ($b_j$), as seen in the direction of the printing width, of each of the one of multiple and all of the axial sections ($a_j$), which are embodied as active sections ($a_j$) having an active width ($b_j$) of the drying elements in the printing unit, over the extension of said sections, overlaps with an adjacent axial section ($a_j$).

4. The device according to claim 1, one of wherein the drying elements and one of the switching and adjusting means assigned to each of these drying elements is operated between two switching states, an active switching state and an inactive switching state, and wherein the drying elements embodied as switchable between an "on" switching state and an "off" switching state by the use of one of binary switching and adjusting means assigned to each drying element.

5. The device according to claim 4, wherein a control device is provided, which control device can one of be used to activate different selections of at least one of the I drying elements to selectively one of produce and form one of sections ("2 I") that are treated simultaneously by two adjacent drying elements, sections ("I") that are treated by only one drying element, and untreated sections ("–"), over an active width covered by the drying device, and can be used in one operating situation to activate a plurality of the I drying elements, to form at least one section (2 I) treated simultaneously by two adjacent drying elements, and at least one section ("I") that is treated by only one drying element, and one untreated section ("–"), over the active width covered by the drying device.

6. The device according to claim 1, wherein the control device comprises a control logic, by which a parameter that is input for an axial section ($a_j$) by use of the control elements one of can be and is converted to a signal for a corresponding adjustment of one of a switching and an adjusting means for an operating medium to be fed to the drying elements, and one of can be and is converted to a signal sequence for a clocked switching, corresponding to the input parameter, of the one of a switching and adjusting means between an "on" switching state and an "off" switching state.

7. The device according to claim 1, wherein one of multiple and all of the drying elements assigned to the axial sections ($a_j$) for the removal of dampening medium can each be varied individually, in terms of the intensity of its action with respect to a circumferential section in an axial section ($a_j$) between an inactive operating state, an active operating state that represents one of a maximum value, and at least one active operating state that assumes a discrete intermediate value which lies therebetween, and an intermediate value that lies within a continuous adjustment range, by use of control elements that can be manipulated by press operators, and a control device that is connected to the control elements for signaling purposes.

8. The device according to claim 1, one of wherein the drying elements are embodied as blowing elements for forming a divergent fluid jet, which one of corresponds, during operation, to a base width ($b_s$), extending in the axial direction, of no more than 50% of the active width ($b_i$) of the axial section ($a_j$) in a region of the surface to be dried, and which opens, during operation, at a jet angle ($\alpha$) of at least 40° from an output of the blowing elements to two ends of the axial section ($a_i$) that is formed by the impingement, and wherein the drying element is embodied as a nozzle.

9. The device according to claim 1, wherein the drying device is one of arranged in the printing unit to cooperate with one of a lateral surface of the printing unit cylinder or and a roller of one of the inking and the dampening unit, and the drying device is arranged in the printing unit so as to cooperate with one of a roller to be assigned to the roller train of the inking unit and with a roller that forms nip points with at least two adjacent rollers and/or and with a roller that is arranged upstream of an inking forme roller in the roller train and with a roller that is arranged in an as yet undivided strand of rollers in a roller train that divides downstream, and with a roller that has a soft surface.

10. The device according to claim 1, wherein a common line that supplies at least a plurality of the drying elements with operating medium, is provided with one of a switching and an adjusting means, which can be used to adjust the operating medium potential that is present at least on the intake side and which determines a level of jet power that can be achieved for the drying elements that are supplied jointly by the common line.

11. The device according to claim 1, wherein when the printing unit is in a stationary active operating situation, clocking with one of a stationary cycle length and frequency is provided.

12. A method for one of adjusting and modifying a profile in a supply of dampening medium extending in a direction of a printing width, and wherein, during operation, excess dampening medium is removed from a printing unit, from a plurality of axial sections arranged offset relative to one another in the direction of a printing width, by using a drying device having a plurality of drying elements, which are individually adjustable in terms of their action, including removing, in at least one operating situation, dampening medium from at least one axial section ($a_j$), overlapping a length of at least 20% of the active width ($b_j$) of the axial section ($a_j$), which is formed as an active section ($a_j$) of an active drying element, with an active width ($b_{j-1}$; $b_{j+1}$) of an axial section ($a_{j-1}$; $a_{j+1}$) that is embodied as an active section ($a_{j-1}$; $a_{j+1}$) of an adjacent active drying element of the drying elements, which are offset axially relative to one another in the direction of the printing width.

13. The method according to claim 12, further including adjusting the extent of the influence in the axial section ($a_j$) on the surface to be treated individually to an operating state that lies between an inactive operating state and an operating state with maximum action by operating the drying element discontinuously in a clocked manner between an "off" switching state and an "on" switching state.

14. The method according to claim 12, further including that at the same time, a different axial section, or in another operating situation, the same axial section ($a_j$; $a_{j+1}$; $a_{j+2}$) or an axial section different from the axial section ($a_j$; $a_{j+1}$; $a_{j+2}$) of an active drying element one of is not overlapping and overlaps less than 20% of its active width ($b_j$) with the active width ($b_{j-1}$; $b_{j+1}$) of an axial section ($a_{j-1}$; $a_{j+1}$) embodied as the active section ($a_{j-1}$; $a_{j+1}$) of an adjacent active drying element.

15. The method according to claim 12, further including, in that for one of adjusting and modifying the profile, adjusting one or more of the drying elements remotely using control elements of an operator interface that is controllable by press operators.

16. A printing unit of a printing press having a device according to claim 1, characterized by the embodiment of the printing unit as one of a collect printing unit having a transfer cylinder that cooperates upstream, with respect to the flow of ink, with a plurality of forme cylinders and downstream with a printing unit cylinder that serves as a counter bearing for the transfer cylinder and by the arrangement of the printing unit in a printing unit assembly of a printing press being embodied as a security printing press.

* * * * *